US009214771B2

(12) United States Patent
Nugent

(10) Patent No.: US 9,214,771 B2
(45) Date of Patent: Dec. 15, 2015

(54) CONNECTOR FOR A CABLE

(71) Applicant: John Mezzalingua Associates, LLC, Liverpool, NY (US)

(72) Inventor: Adam Thomas Nugent, Canastota, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 20 days.

(21) Appl. No.: 14/093,664

(22) Filed: Dec. 2, 2013

(65) Prior Publication Data

US 2014/0199886 A1 Jul. 17, 2014

Related U.S. Application Data

(63) Continuation of application No. 13/178,443, filed on Jul. 7, 2011, now Pat. No. 8,628,352.

(51) Int. Cl.

| | |
|---|---|
| ***H01R 9/05*** | (2006.01) |
| ***H01R 24/38*** | (2011.01) |
| ***H01R 43/20*** | (2006.01) |

(52) U.S. Cl.

CPC ..... *H01R 24/38* (2013.01); *H01R 9/05* (2013.01); *H01R 43/20* (2013.01); *Y10T 29/49208* (2015.01)

(58) Field of Classification Search

CPC .. H01R 24/564; H01R 9/0521; H01R 13/622; H01R 9/0524; H01R 9/0527; H01R 9/05

USPC ..... 439/587

See application file for complete search history.

(56) References Cited

U.S. PATENT DOCUMENTS

| | | | | |
|---|---|---|---|---|
| 2,152,504 | A * | 3/1939 | Scott et al. | 174/75 C |
| 3,764,959 | A | 10/1973 | Toma et al. | |
| 3,910,673 | A | 10/1975 | Stokes | |
| 4,531,805 | A | 7/1985 | Werth | |
| 4,579,415 | A | 4/1986 | Van Brunt et al. | |
| 4,676,577 | A | 6/1987 | Szegda | |
| 4,728,304 | A * | 3/1988 | Fischer | 439/842 |
| 4,808,128 | A | 2/1989 | Werth | |
| 4,932,898 | A * | 6/1990 | Goodman et al. | 439/582 |
| 4,952,174 | A | 8/1990 | Sucht et al. | |
| 5,137,470 | A | 8/1992 | Doles | |
| 5,167,533 | A | 12/1992 | Rauwolf | |
| 5,199,894 | A | 4/1993 | Kalny et al. | |
| 5,322,454 | A | 6/1994 | Thommen | |
| 5,393,244 | A | 2/1995 | Szegda | |
| 5,397,243 | A | 3/1995 | MacMurdo, Sr. | |

(Continued)

FOREIGN PATENT DOCUMENTS

| | | |
|---|---|---|
| DE | 4344328 C1 | 1/1995 |
| EP | 1732172 A1 | 12/2006 |

(Continued)

OTHER PUBLICATIONS

U.S. Appl. No. 61/505,535, filed Jul. 8, 2011.

*Primary Examiner* — Truc Nguyen

(74) *Attorney, Agent, or Firm* — Barclay Damon, LLP

(57) ABSTRACT

A connector for a cable, in one embodiment, has a body configured to receive a cable. The connector has a plurality of contacts moveably positioned within the body, and the connector has a component configured to slide or axially move.

18 Claims, 10 Drawing Sheets

(56) References Cited

U.S. PATENT DOCUMENTS

| | | | | |
|---|---|---|---|---|
| 5,435,745 | A | 7/1995 | Booth | |
| 5,518,420 | A | 5/1996 | Pitschi | |
| 5,620,339 | A | 4/1997 | Gray et al. | |
| 5,720,630 | A | 2/1998 | Richmond et al. | |
| 5,766,037 | A * | 6/1998 | Nelson | 439/583 |
| 5,863,220 | A | 1/1999 | Holliday | |
| 5,938,474 | A | 8/1999 | Nelson | |
| 5,984,723 | A * | 11/1999 | Wild | 439/583 |
| 6,019,519 | A | 2/2000 | Grinderslev et al. | |
| 6,019,635 | A * | 2/2000 | Nelson | 439/583 |
| 6,019,636 | A | 2/2000 | Langham | |
| 6,032,358 | A | 3/2000 | Wild | |
| 6,102,738 | A | 8/2000 | Macek et al. | |
| 6,106,333 | A * | 8/2000 | Purdy | 439/578 |
| 6,109,964 | A | 8/2000 | Kooiman | |
| 6,123,567 | A | 9/2000 | McCarthy | |
| 6,126,482 | A | 10/2000 | Stabile | |
| 6,133,532 | A | 10/2000 | Lundback et al. | |
| 6,183,298 | B1 | 2/2001 | Henningsen et al. | |
| 6,203,360 | B1 | 3/2001 | Harting et al. | |
| 6,206,579 | B1 | 3/2001 | Selfridge et al. | |
| 6,264,374 | B1 | 7/2001 | Selfridge et al. | |
| 6,267,621 | B1 | 7/2001 | Pitschi et al. | |
| 6,272,738 | B1 | 8/2001 | Holliday et al. | |
| 6,309,251 | B1 | 10/2001 | Tang | |
| 6,331,123 | B1 | 12/2001 | Rodrigues | |
| 6,361,348 | B1 * | 3/2002 | Hall et al. | 439/352 |
| 6,386,915 | B1 | 5/2002 | Nelson | |
| 6,471,545 | B1 | 10/2002 | Hosler, Sr. | |
| 6,478,618 | B2 | 11/2002 | Wong | |
| 6,494,743 | B1 | 12/2002 | Lamatsch et al. | |
| 6,569,565 | B2 | 5/2003 | Ligeois et al. | |
| 6,607,398 | B2 | 8/2003 | Henningsen | |
| 6,733,336 | B1 | 5/2004 | Montena et al. | |
| 6,840,803 | B2 | 1/2005 | Wlos et al. | |
| 6,860,761 | B2 | 3/2005 | Lee et al. | |
| 6,878,049 | B2 | 4/2005 | Heidelberger et al. | |
| 6,884,113 | B1 | 4/2005 | Montena | |
| 6,884,115 | B2 | 4/2005 | Malloy | |
| 6,939,169 | B2 | 9/2005 | Islam et al. | |
| 6,955,562 | B1 | 10/2005 | Henningsen | |
| 6,976,872 | B1 | 12/2005 | Wild et al. | |
| 7,008,264 | B2 | 3/2006 | Wild | |
| 7,021,965 | B1 | 4/2006 | Montena | |
| 7,029,304 | B2 | 4/2006 | Montena | |
| 7,029,326 | B2 | 4/2006 | Montena | |
| 7,070,447 | B1 | 7/2006 | Montena | |
| 7,077,699 | B2 | 7/2006 | Islam et al. | |
| 7,086,897 | B2 | 8/2006 | Montena | |
| 7,104,839 | B2 | 9/2006 | Henningsen et al. | |
| 7,108,547 | B2 | 9/2006 | Kisling et al. | |
| 7,112,093 | B1 | 9/2006 | Holland | |
| 7,121,883 | B1 | 10/2006 | Petersen et al. | |
| 7,128,603 | B2 | 10/2006 | Burris et al. | |
| 7,131,868 | B2 | 11/2006 | Montena | |
| 7,156,560 | B2 | 1/2007 | Seeley | |
| 7,156,696 | B1 | 1/2007 | Montena | |
| 7,163,420 | B2 | 1/2007 | Montena | |
| 7,189,115 | B1 * | 3/2007 | Montena | 439/584 |
| 7,207,838 | B2 | 4/2007 | Andreescu | |
| 7,264,502 | B2 | 9/2007 | Holland | |
| 7,270,569 | B2 | 9/2007 | Petersen et al. | |
| 7,278,854 | B1 | 10/2007 | Robinette et al. | |
| 7,303,435 | B2 | 12/2007 | Burris et al. | |
| 7,309,255 | B2 | 12/2007 | Rodrigues | |
| 7,326,079 | B2 | 2/2008 | Holliday et al. | |
| 7,335,059 | B2 | 2/2008 | Vaccaro | |
| 7,347,729 | B2 | 3/2008 | Thomas et al. | |
| 7,351,101 | B1 | 4/2008 | Montena | |
| 7,357,672 | B2 | 4/2008 | Montena | |
| 7,374,455 | B2 * | 5/2008 | Purdy et al. | 439/578 |
| 7,458,850 | B1 | 12/2008 | Burris et al. | |
| 7,458,851 | B2 | 12/2008 | Montena | |
| 7,497,729 | B1 | 3/2009 | Wei | |
| 7,513,722 | B2 | 4/2009 | Greenberg et al. | |
| 7,527,512 | B2 | 5/2009 | Montena | |
| 7,566,243 | B1 | 7/2009 | Hung | |
| 7,588,460 | B2 | 9/2009 | Malloy et al. | |
| 7,632,143 | B1 | 12/2009 | Islam | |
| 7,637,774 | B1 * | 12/2009 | Vaccaro | 439/578 |
| 7,753,725 | B2 | 7/2010 | Henningsen | |
| 7,806,724 | B2 | 10/2010 | Paynter et al. | |
| 7,824,215 | B2 | 11/2010 | Islam et al. | |
| 7,857,661 | B1 | 12/2010 | Islam | |
| 7,918,687 | B2 | 4/2011 | Paynter et al. | |
| 7,927,134 | B2 * | 4/2011 | Paynter et al. | 439/578 |
| D643,370 | S | 8/2011 | Eriksen et al. | |
| 7,993,159 | B2 | 8/2011 | Chawgo | |
| 8,007,314 | B2 * | 8/2011 | Chawgo et al. | 439/548 |
| 8,038,472 | B2 | 10/2011 | Montena et al. | |
| 8,047,870 | B2 | 11/2011 | Clausen | |
| 8,096,829 | B2 | 1/2012 | Malloy et al. | |
| 8,109,786 | B2 * | 2/2012 | Lee et al. | 439/578 |
| 8,123,557 | B2 | 2/2012 | Montena et al. | |
| 8,136,236 | B2 | 3/2012 | Amato | |
| 8,177,583 | B2 | 5/2012 | Chawgo et al. | |
| 8,298,006 | B2 | 10/2012 | Wild et al. | |
| 8,430,688 | B2 | 4/2013 | Montena et al. | |
| 8,435,073 | B2 | 5/2013 | Wild et al. | |
| 8,439,703 | B2 | 5/2013 | Natoli | |
| 2005/0079761 | A1 | 4/2005 | Rodrigues | |
| 2006/0014427 | A1 | 1/2006 | Islam et al. | |
| 2006/0134979 | A1 | 6/2006 | Henningsen | |
| 2006/0189188 | A1 | 8/2006 | Holliday et al. | |
| 2006/0199431 | A1 | 9/2006 | Paynter | |
| 2006/0246774 | A1 | 11/2006 | Buck | |
| 2007/0004277 | A1 | 1/2007 | Petersen et al. | |
| 2007/0149047 | A1 | 6/2007 | Wild et al. | |
| 2007/0270032 | A1 | 11/2007 | Eriksen | |
| 2007/0298654 | A1 | 12/2007 | Holliday | |
| 2008/0003873 | A1 | 1/2008 | Henningsen | |
| 2008/0104829 | A1 | 5/2008 | Munsterman | |
| 2008/0207051 | A1 | 8/2008 | Montena | |
| 2008/0254678 | A1 | 10/2008 | Amidon | |
| 2008/0274643 | A1 | 11/2008 | Chawgo | |
| 2009/0197465 | A1 | 8/2009 | Montena et al. | |
| 2009/0233482 | A1 | 9/2009 | Chawgo et al. | |
| 2009/0269979 | A1 | 10/2009 | Montena | |
| 2010/0029149 | A1 | 2/2010 | Malloy et al. | |
| 2010/0178799 | A1 | 7/2010 | Lee et al. | |
| 2010/0261381 | A1 | 10/2010 | Montena et al. | |
| 2010/0261382 | A1 | 10/2010 | Montena et al. | |
| 2010/0273340 | A1 | 10/2010 | Clausen | |
| 2011/0008998 | A1 | 1/2011 | Low et al. | |
| 2011/0009000 | A1 | 1/2011 | Paynter | |
| 2011/0021074 | A1 | 1/2011 | Paynter et al. | |
| 2011/0263154 | A1 | 10/2011 | Chawgo et al. | |
| 2012/0088404 | A1 | 4/2012 | Wild et al. | |
| 2012/0088405 | A1 | 4/2012 | Wild et al. | |
| 2012/0088406 | A1 | 4/2012 | Montena et al. | |
| 2012/0088407 | A1 | 4/2012 | Natoli | |
| 2012/0102733 | A1 | 5/2012 | Wild | |
| 2012/0214338 | A1 | 8/2012 | Nugent | |
| 2012/0252265 | A1 | 10/2012 | Wild et al. | |
| 2013/0012064 | A1 | 1/2013 | Nugent | |
| 2013/0143439 | A1 | 6/2013 | Nugent et al. | |
| 2013/0178097 | A1 | 7/2013 | Wild et al. | |

FOREIGN PATENT DOCUMENTS

| | | | |
|---|---|---|---|
| EP | 1858123 | A2 | 11/2007 |
| EP | 2190068 | A1 | 5/2010 |
| EP | 2219267 | B1 | 8/2010 |
| KR | 200351496 | Y1 | 5/2004 |
| WO | 0001038 | A1 | 1/2000 |
| WO | 2005004290 | A1 | 1/2005 |
| WO | 2005004490 | | 1/2005 |
| WO | 2007101435 | A1 | 9/2007 |
| WO | 2010117890 | | 10/2010 |
| WO | 2012048260 | A1 | 4/2012 |
| WO | 2012048260 | A9 | 4/2012 |
| WO | 2013006668 | | 1/2013 |

* cited by examiner

Channel Settings

| Channel | Sweep Type | Points | Start (MHz) | Stop (GHz) | IF BW (kHz) | Sweep Time (s) | Pow 1 (dBm) | Pow 2 (dBm) |
|---|---|---|---|---|---|---|---|---|
| 1 | LinFreq | 1601 | 4.996880 | 8.000000 | 3.000000 | 0.541778 | 0.000000 | 0.000000 |

Trace Attributes

| Window | ID | Trace | Channel | Correction | Options | Maker | Postition | Response |
|---|---|---|---|---|---|---|---|---|
| 1 | 1 | DM/DF Airline | 1 | C 1-Port | G | 1 | 5 MHz | -58.402 dB |

To FIG. 9B

Channel Settings

| Channel | Sweep Type | Points | Start (MHz) | Stop (GHz) | IF BW (kHz) | Sweep Time (s) | Pow 1 (dBm) | Pow 2 (dBm) |
|---|---|---|---|---|---|---|---|---|
| 1 | LinFreq | 1601 | 4.996880 | 8.000000 | 3.000000 | 0.541778 | 0.000000 | 0.000000 |

Trace Attributes

| Window | ID | Trace | Channel | Correction | Options | Maker | Position | Response |
|---|---|---|---|---|---|---|---|---|
| 1 | 1 | DM/DF Airline | 1 | C 1-Port | G | 1 | 5 MHz | -58.402 dB |
| | | | | | | 2 | 1000 MHz | -49.563 dB |
| | | | | | | 3 | 2000 MHz | -43.122 dB |
| | | | | | | 4 | 4000 MHz | -48.007 dB |
| | | | | | | 5 | 6000 MHz | -28.124 dB |

CONNECTOR FOR A CABLE

PRIORITY CLAIM

This application is a continuation of, and claims the benefit and priority of, U.S. patent application Ser. No. 13/178,443, filed on Jul. 7, 2011. The entire contents of such application is hereby incorporated by reference.

CROSS REFERENCE TO RELATED APPLICATIONS

This application is related to the following commonly-owned, co-pending patent applications: (a) U.S. patent application Ser. No. 13/969,985, filed on Aug. 19, 2013; (b) U.S. patent application Ser. No. 13/913,060, filed on Jun. 7, 2013; (c) U.S. Patent Application Ser. No. 61/87,612, filed on Apr. 30, 2013; (d) U.S. patent application Ser. No. 13/723,859, filed on Dec. 21, 2012; (e) U.S. patent application Ser. No. 13/401,835, filed on Feb. 21, 2012; (f) U.S. patent application Ser. No. 13/237,563, filed on Sep. 20, 2011; and (g) U.S. patent application Ser. No. 13/150,682, filed on Jun. 1, 2011.

BACKGROUND

1. Technical Field

The following relates to connectors used in coaxial cable communications, and more specifically to embodiments of a connector that improve the clamping of a center conductor.

2. State of the Art

Coaxial cables are electrical cables that are used as transmission lines for electrical signals. Coaxial cables are composed of a center conductor surrounded by a flexible insulating layer, which in turn is surrounded by an outer conductor that acts as a conducting shield. An outer protective sheath or jacket surrounds the outer conductor. Each type of coaxial cable has a characteristic impedance which is the opposition to signal flow in the coaxial cable. The impedance of a coaxial cable depends on its dimensions and the materials used in its manufacture. For example, a coaxial cable can be tuned to a specific impedance by controlling the diameters of the inner and outer conductors and the dielectric constant of the insulating layer. All of the components of a coaxial system should have the same impedance in order to reduce internal reflections at connections between components. Such reflections increase signal loss and can result in the reflected signal reaching a receiver with a slight delay from the original. Return loss is defined loosely as the ratio of incident signal to reflected signal in a coaxial cable and refers to that portion of a signal that cannot be absorbed by the end of coaxial cable termination, or cannot cross an impedance change at some point in the coaxial cable line.

Two sections of a coaxial cable in which it can be difficult to maintain a consistent impedance are the terminal sections on either end of the cable to which connectors are attached. A coaxial cable in an operational state typically has a connector affixed on one or either end of the cable. These connectors are typically connected to complementary interface ports or corresponding connectors to electrically integrate the coaxial cable to various electronic devices. The center conductor of the coaxial cable carries an electrical signal and can be connected to an interface port or corresponding connector via a conductive union between the connector and the center conductor. The contact of the conductive union is critical for desirable passive intermodulation (PIM) results. However, the axial displacement associated with a connector moving into a closed position from an open position often times adversely affects the contact between the center conductor and the connector and/or the distance between conductors. The result of a poor conductive union between the center conductor and the connector leads to diminished performance of the connector in transmitting the electrical signal from the cable to the integrated electronic device. Likewise, the result of altering the distance between conductors introduces deviation from the characteristic impedance of the cable and results in diminished performance of the connector.

In field-installable connectors, such as compression connectors or screw-together connectors, it can be difficult to maintain acceptable levels of passive intermodulation (PIM). PIM in the terminal sections of a coaxial cable can result from nonlinear and insecure contact between surfaces of various components of the connector. Moreover, PIM can result from stretching or cracking various component parts of the connector during assembly. A nonlinear contact between two or more of these surfaces can cause micro arcing or corona discharge between the surfaces, which can result in the creation of interfering RF signals. For example, some screw-together connectors are designed such that the contact force between the connector and the outer conductor is dependent on a continuing axial holding force of threaded components of the connector. Over time, the threaded components of the connector can inadvertently separate, thus resulting in nonlinear and insecure contact between the connector and the outer conductor.

Where the coaxial cable is employed on a cellular communications tower, for example, unacceptably high levels of PIM in terminal sections of the coaxial cable and resulting interfering RF signals can disrupt communication between sensitive receiver and transmitter equipment on the tower and lower-powered cellular devices. Disrupted communication can result in dropped calls or severely limited data rates, for example, which can result in dissatisfied customers and customer churn.

Current attempts to solve these difficulties with field-installable connectors generally consist of employing a pre-fabricated jumper cable having a standard length and having factory-installed soldered or welded connectors on either end. These soldered or welded connectors generally exhibit stable impedance matching and PIM performance over a wider range of dynamic conditions than current field-installable connectors. These pre-fabricated jumper cables are inconvenient, however, in many applications.

For example, each particular cellular communication tower in a cellular network generally requires various custom lengths of coaxial cable, necessitating the selection of various standard-length jumper cables that is each generally longer than needed, resulting in wasted cable. Also, employing a longer length of cable than is needed results in increased insertion loss in the cable. Further, excessive cable length takes up more space on the tower. Moreover, it can be inconvenient for an installation technician to have several lengths of jumper cable on hand instead of a single roll of cable that can be cut to the needed length. Also, factory testing of factory-installed soldered or welded connectors for compliance with impedance matching and PIM standards often reveals a relatively high percentage of non-compliant connectors. This percentage of non-compliant, and therefore unusable, connectors can be as high as about ten percent of the connectors in some manufacturing situations. For all these reasons, employing factory-installed soldered or welded connectors on standard-length jumper cables to solve the above-noted difficulties with field-installable connectors is not an ideal solution.

Accordingly, during movement of the connector and its internal components when mating with a port, the conductive components may break contact with other conductive components of the connector or conductors of a coaxial cable, causing undesirable passive intermodulation (PIM) results. For instance, the contact between a center conductor of a coaxial cable and a receptive clamp is critical for desirable passive intermodulation (PIM) results. Likewise, poor clamping of the coaxial cable within the connector allows the cable to displace and shift in a manner that breaks contact with the conductive components of the connector, causing undesirable PIM results. Furthermore, poor clamping causes a great deal of strain to the connector.

Thus, there is a need for an apparatus that addresses the issues described above, and in particular there is a need for a coaxial cable assembly and method that provides an acceptable conductive union between the conductors of the coaxial cable and the connector.

SUMMARY

The following relates to connectors used in coaxial cable communications, and more specifically to embodiments of a connector that improve the conductive union between the conductors of a coaxial cable and the connector.

A first general aspect relates to a contact having a through bore in a portion thereof.

A second general aspect relates to concurrent movement and engagement of both a center conductor and an outer conductor of a coaxial cable to the connector when the connector is transitioned between a non-operational state and an operational state.

A third general aspect relates to a method of ensuring concurrent movement and equal rate of movement of both a center conductor and an outer conductor of a coaxial cable within the connector when the connector is transitioned between a non-operational state and an operational state.

A fourth general aspect relates to a connector comprising A connector comprising a body; a compression member, wherein the body and the compression member are configured to slidably engage each other with a cable secured therein; a contact, the contact having a through bore in a portion thereof; a pin, the pin having a socket and a protrusion on opposing ends of the pin; and an engagement member, wherein under the condition that the body and compression member are axially advanced toward one another, a center conductor of the cable is axially advanced within and secured by the socket, the protrusion of the pin is concurrently axially advanced into the through bore, and an outer conductor of the cable is concurrently compressed by the engagement member.

A fifth general aspect relates to a means for concurrently moving and engaging both a center conductor and an outer conductor of a coaxial cable to a connector when the connector is transitioned between a non-operational state and an operational state.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms “a”, “an” and “the” include plural referents, unless the context clearly dictates otherwise.

Figure 1:
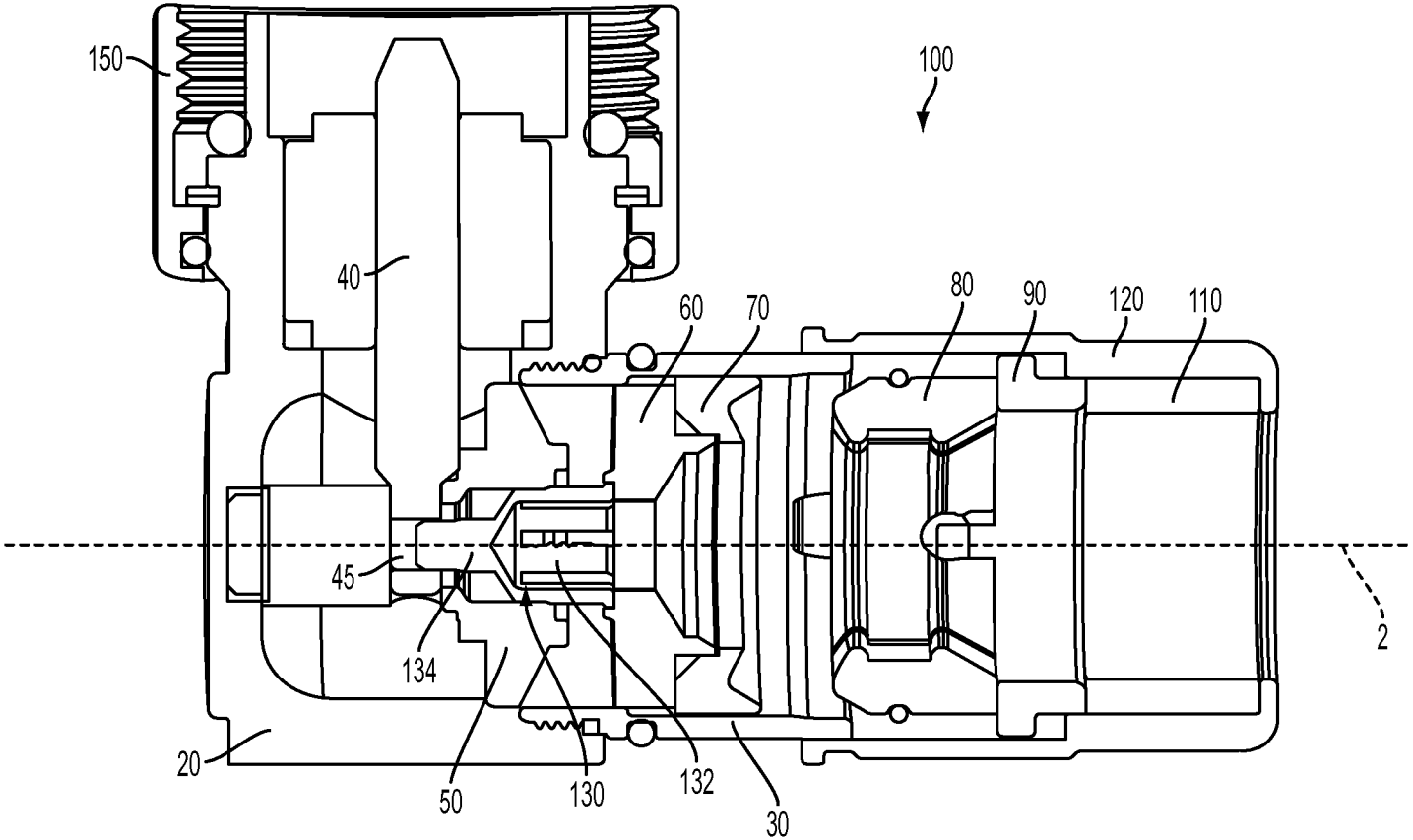
FIG. 1 depicts a cross-sectional view of an embodiment of a connector in an open position.

Referring to the drawings, FIG. 1 depicts an embodiment of a connector 100. Connector 100 may be a right angle connector, an angled connector, an elbow connector, an interface port, or any complimentary angled connector or port that may receive a center conductive strand 18 of a coaxial cable. Further embodiments of connector 100 may receive a center conductive strand 18 of a coaxial cable 10, wherein the coaxial cable 10 includes a corrugated or otherwise exposed outer conductor 14.

Connector 100 may be configured to attach to a coaxial cable 10 in the field during actual installation of the coaxial cable. While installing coaxial cable, coaxial cable 10 may be terminated at a specific length by an installer and the terminal end of the cable may be prepared to receive a connector, such as connector 100. Connector 100 may thereafter be utilized to couple to the prepared end of the cable 10, such that the connector 100 can couple to a port or other interface to establish electrical communication between the coaxial cable and the interface. In this way, the length of cable 10 used during the installation of the cable line can be uniquely tailored to the specific length desired/needed by the specific installation requirements.

Alternatively, connector 100 can be provided to a user in a preassembled configuration to ease handling and installation during use. Two connectors, such as connector 100 may be utilized to create a jumper that may be packaged and sold to a consumer. A jumper may be a coaxial cable 10 having a connector, such as connector 100, operably affixed at one end of the cable 10 where the cable 10 has been prepared, and another connector, such as connector 100, operably affixed at the other prepared end of the cable 10. Operably affixed to a prepared end of a cable 10 with respect to a jumper includes both an uncompressed/open position and a compressed/closed position of the connector 100 while affixed to the cable 10. For example, embodiments of a jumper may include a first connector including components/features described in association with connector 100, and a second connector that may also include the components/features as described in association with connector 100, wherein the first connector is operably affixed to a first end of a coaxial cable 10, and the second connector is operably affixed to a second end of the coaxial cable 10. Embodiments of a jumper may include other components, such as one or more signal boosters, molded repeaters, and the like.

Figure 2A:
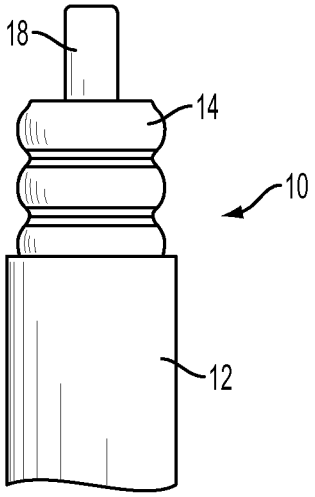
FIG. 2A depicts a side view of an embodiment of a coaxial cable.
Figure 2B:
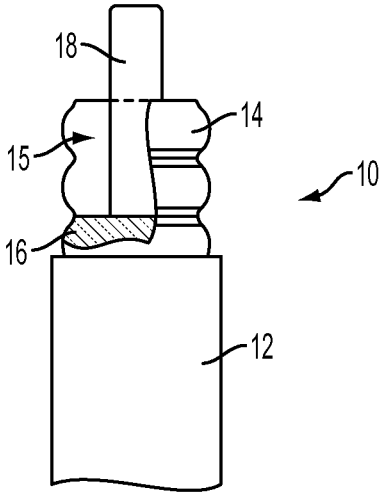
FIG. 2B depicts a cut-away side view of an embodiment of the coaxial cable.

Referring now to FIGS. 2A and 2B, embodiments of a coaxial cable 10 may be securely attached to a coaxial cable connector. The coaxial cable 10 may include a center conductive strand 18, surrounded by an interior dielectric 16; the interior dielectric 16 may possibly be surrounded by a conductive foil layer; the interior dielectric 16 (and the possible conductive foil layer) is surrounded by a conductive strand layer 14; the conductive strand layer 14 is surrounded by a protective outer jacket 12, wherein the protective outer jacket 12 has dielectric properties and serves as an insulator. The conductive strand layer 14 may extend a grounding path providing an electromagnetic shield about the center conductive strand 18 of the coaxial cable 10. The conductive strand layer 14 may be a rigid outer conductor of the coaxial cable 10, and may be corrugated or otherwise grooved. For instance, the outer conductive strand layer 14 may be smooth walled, spiral corrugated, annular corrugated, or helical corrugated.

The coaxial cable 10 may be prepared by removing the protective outer jacket 12 and coring out a portion of the dielectric 16 (and possibly the conductive foil layer that may tightly surround the interior dielectric 16) surrounding the center conductive strand 18 to expose the outer conductive strand 14 and create a cavity 15 or space between the outer conductive strand 14 and the center conductive strand 18. The protective outer jacket 12 can physically protect the various components of the coaxial cable 10 from damage that may result from exposure to dirt or moisture, and from corrosion. Moreover, the protective outer jacket 12 may serve in some measure to secure the various components of the coaxial cable 10 in a contained cable design that protects the cable 10 from damage related to movement during cable installation. The conductive strand layer 14 can be comprised of conductive materials suitable for carrying electromagnetic signals and/or providing an electrical ground connection or electrical path connection. Various embodiments of the conductive strand layer 14 may be employed to screen unwanted noise. In some embodiments, there may be flooding compounds protecting the conductive strand layer 14. The dielectric 16 may be comprised of materials suitable for electrical insulation. The protective outer jacket 12 may also be comprised of materials suitable for electrical insulation.

It should be noted that the various materials of which all the various components of the coaxial cable 10 should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive strand layer 14, possible conductive foil layer, interior dielectric 16 and/or center conductive strand 18 may vary based upon generally recognized parameters corresponding to broadband communication standards and/or equipment.

Figure 3:
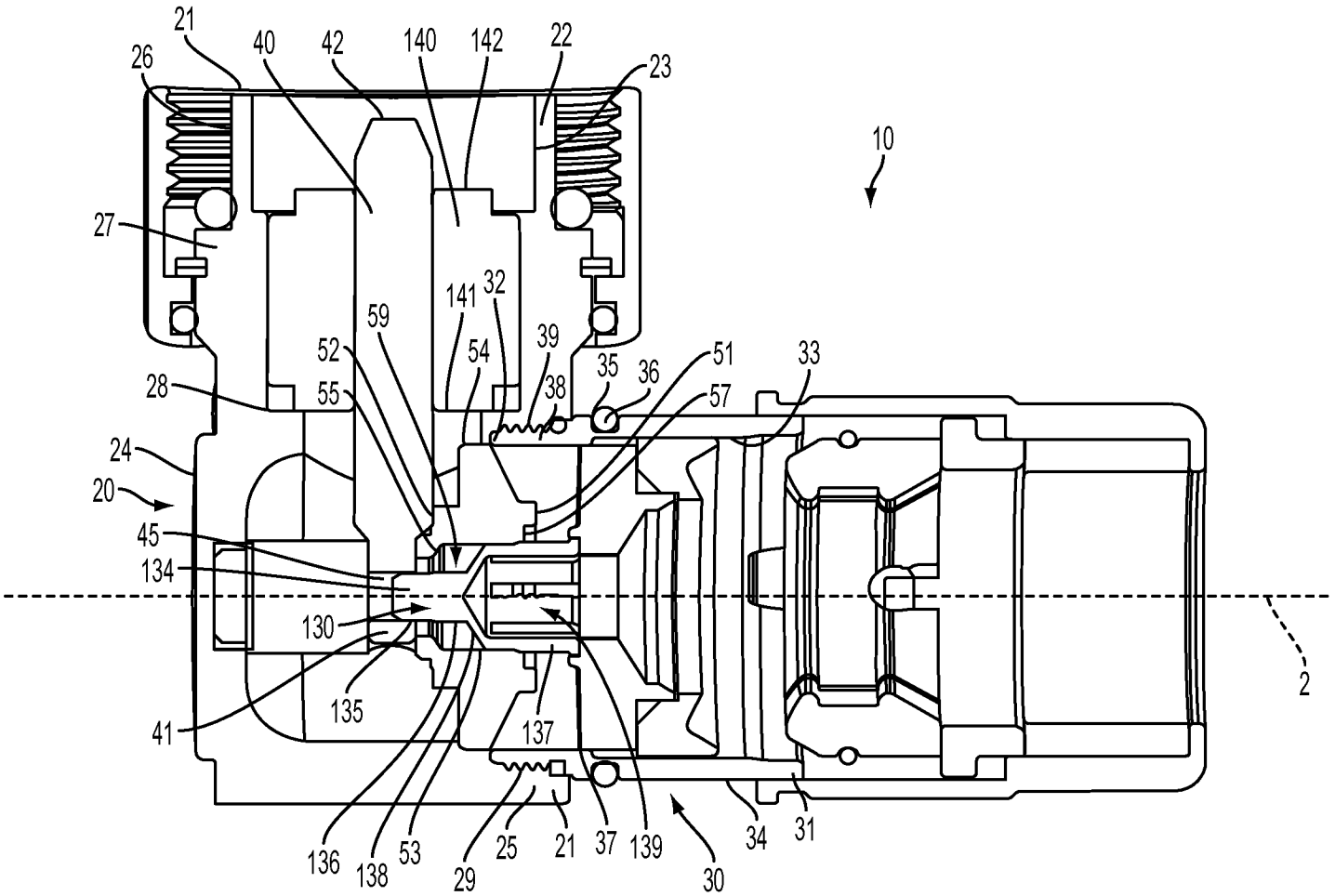
FIG. 3 depicts a cross-sectional view of an embodiment of a connector in an open position.

Referring now to FIGS. 1 and 3, embodiments of connector 100 may include a main body 30, a front body 20, a contact 40, a first insulator body 50, a second insulator body 60, a compression ring 70, an outer conductor engagement member 80, a flanged bushing 90, a bushing 110, and a compression member 120. Further embodiments of the connector 100 may include a main body 30 having a first end 31 and a second end 32, the main body 30 configured to receive a prepared coaxial cable 10, a compression member 120 having a first end 121 and a second end 122, the second end 122 of the compression member 120 configured to engage the main body 130, a contact 40 having a through bore 45, a pin 130 having a socket 132, the pin configured to engage the through bore 45, the socket 132 disposed within the connector 100 and configured to receive a center conductive strand 18 of the coaxial cable 10, wherein axial advancement of the compression member 120 toward the main body 30 from a first state to a second state creates a resultant contact between the socket 132 and the center conductive strand 18 and between the pin 130 and the contact 40.

Embodiments of connector 100 may include a main body 30. Main body 30 may include a first end 31, a second end 32, and an outer surface 34. The main body 30 may include a generally axial opening extending from the first end 31 to the second end 32. The inner diameter of the axial opening may include multiple diameters, and in particular a first diameter 33 and a second diameter 38, the first diameter 33 being slightly larger than the second diameter 38 with an internal annular shoulder 37 created where the differing diameters 33 and 38 meet within the main body 30. Embodiments of the main body 30 may also include a threaded portion 39 for threadably engaging, or securably retaining, a front body 20. The threaded portion 39 may be external or exterior threads having a pitch and depth that correspond to internal or interior female threads of the front body 20. The axial opening of the main body 30 may have an internal diameter large enough to allow a first insulator body 50, a second insulator body 60, a pin 130 having a socket 132, a compression ring 70, an outer conductor engagement member 80, and portions of a coaxial cable 10 to enter and remain disposed within the main body 30 while operably configured. Embodiments of the main body 30 may include an annular groove 35 in the outer surface 34, which may be configured to house a sealing member 36 (e.g., an O-ring) therein.

In addition, the main body 30 may be formed of metals or polymers or other materials that would facilitate a rigidly formed body. Manufacture of the main body 30 may include casting, extruding, cutting, turning, tapping, drilling, injection molding, blow molding, or other fabrication methods that may provide efficient production of the component. Those in the art should appreciate that various embodiments of the main body 30 may also comprise various inner or outer surface features, such as annular grooves, indentions, tapers, recesses, and the like, and may include one or more structural components having insulating properties located within the main body 30.

Referring still to FIGS. 1 and 3, embodiments of the connector 100 may include a front body 20. The front body 20 may include a first end 21, a second end 22, an inner surface 23, and an outer surface 24. The front body 20 may include a generally axial opening extending from the first end 21 through to the second end 22, the axial opening of the first end 21 being oriented substantially orthogonally from the axial opening of the second end 22. In other words, the axial opening of the first end 21 may be in a top portion of the front body 20 and the axial opening of the second end 22 may be in a side portion of the front body 20. Proximate or otherwise near the first end 21 of the front body 20 may be an annular indention 25. The annular indention 25 may be sized and dimensioned to engage the generally axial opening of the second end 32 of the main body 30. Disposed on the inner surface of the annular indention 25 may be a threaded portion 29 for threadably engaging, or securably affixing to, the main body 30. In other words, the front body 20 may be coupled to the main body 30. The threaded portion 29 may be internal or interior threads having a pitch and depth that correspond to the external or exterior threads of the main body 30. Moreover, the front body 20 may include an annular recessed portion 26 proximate or otherwise near the second end 22. The annular recessed portion 26 may create a flange 27 extending annularly around the front body 20. Embodiments of the front body 20 may also include an internal protrusion 28 that may protrude or extend a distance from the inner surface 23 of the front body 20, such that a contact insulator 140 may engage the internal protrusion 28. The front body 20 may also be configured to connect, accommodate, receive, or couple with an additional coaxial cable connector. For example, a fastening member 150 (e.g. a nut) may be coupled to the front body 20 so that the front body 20, and therefore the assembled connector 100, may be coupled with an additional coaxial cable connector. In addition, the front body 20 may be formed of metals or polymers or other materials that would facilitate a rigidly formed body. Manufacture of the front body 20 may include casting, extruding, cutting, turning, tapping, drilling, injection molding, blow molding, or other fabrication methods that may provide efficient production of the component. Those in the art should appreciate that various embodiments of the front body 20 may also comprise various inner or outer surface features, such as annular grooves, indentions, tapers, recesses, and the like, and may include one or more structural components having insulating properties located within the front body 20.

With continued reference to FIGS. 1 and 3, embodiments of the connector 100 may include a contact 40. Contact 40 may include a first end 41 and a second end 42. The second end 42 may taper to connect, accommodate, receive, or couple with an additional coaxial cable connector port or coupling device. Contact 40 may be a conductive element that may extend or carry an electrical current and/or signal from a first point to a second point. Contact 40 may be a terminal, a pin, a conductor, an electrical contact, and the like. Contact 40 may have various diameters, sizes, and may be arranged in any alignment throughout the connector 100, depending on the shape or orientation of the connector 100. Furthermore, contact 40 may have a through bore 45 proximate or otherwise near the first end 41. The axis of the through bore 45 may be aligned transverse to the axis of the contact 40. Also, the axis of the through bore 45 may have an internal diameter and the axis of the through bore 45 may be aligned generally parallel with an axis 2 of the main body 30, such that the axis of the through bore 45 is axially aligned with the axis 2 of the connector 100. The through bore 45 may be configured to receive a pin 130, to be described in detail below. The through bore 45 may further include slits (not shown) in the diameter of the through bore 45 to allow radial expansion under the condition that the pin 130 is inserted therein. The contact 40, including the through bore 45 of the contact 40 should be formed of conductive materials, such as, but not limited to, plated brass.

With continued reference to FIGS. 1 and 3, embodiments of the connector 100 may include a contact insulator 140. The contact insulator 140 may include a first end 141 and a second end 142 and a generally axial opening between the first end 141 through to the second end 142. The contact insulator 140 may be disposed within the front body 20 and, the second end 142 being configured to engage the internal protrusion 28 of the front body 28. In embodiments of the connector 100, the axial opening of the contact insulator 140 may be configured to position or otherwise support the contact 40 within the front body 20. Furthermore, the contact insulator 140 should be made of non-conductive, insulator materials. Manufacture of the contact insulator 140 may include casting, extruding, cutting, turning, drilling, compression molding, injection molding, spraying, or other fabrication methods that may provide efficient production of the component.

With continued reference to FIGS. 1 and 3, embodiments of the connector 100 may include a pin 130, the pin comprising an axial protrusion portion 134 and a socket portion 132. The socket portion 132 may be a conductive center conductor clamp or basket that clamps, grips, collects, or mechanically compresses onto the center conductive strand 18. The socket 132 may further include an opening 139, wherein the opening 139 may be a bore, hole, channel, and the like, that may be tapered. The socket 132, in particular, the opening 139 of the socket 132 may accept, receive, and/or clamp an incoming center conductive strand 18 of the coaxial cable 10 as a coaxial cable 10 is axially advanced into the main body 30 from a first position, or an open position, to a second position, or a closed position. The socket 132 may include a plurality of engagement fingers 137 that may permit deflection and reduce (or increase) the diameter or general size of the opening 139. In other words, the socket 132 of pin 130 may be slotted or otherwise resilient to permit deflection of the socket 132 as the coaxial cable 10 is further inserted into the main body 30 to achieve a closed position, or as the compression member 120 is axially displaced further onto main body 30. In an open position, or prior to full insertion of the coaxial cable 10, the plurality of engagement fingers 137 may be in a spread open configuration, or at rest, to efficiently engage, collect, capture, etc., the center conductive strand 18. Furthermore, the spread open configuration of the plurality of engagement fingers 137 may define a tapered opening 139 of the socket 132. Embodiments of a tapered opening 139 may taper, or become gradually larger in diameter towards the opening of the socket 132. The tapered opening 139 embodiment may allow more contact (e.g. parallel line contact as opposed to point(s) contact) between the socket 132 and the center conductive strand 18 resulting in a more stable interface.

For instance, the plurality of engagement fingers 137 may contact an internal surface 53 of an opening 59 of the first insulator body 50 that can radially compress the plurality of engagement fingers 137 onto the center conductive strand 18 as the coaxial cable 10 is further axially inserted into the main body 30, ensuring desirable passive intermodulation results. Alternatively, the plurality of engagement fingers 137 may be radially compressed cylindrically or substantially cylindrically around the center conductive strand 18 as compression member 120 is further axially inserted onto the main body 30. Because of the internal geometry (e.g. cylindrical or tapered) of the first insulator body 50 and the socket 132, the radial compression of the socket 132 onto the center conductive strand 18 may result in parallel line contact. In other words, the resultant contact between the socket 132 and the center conductive strand 18 may be co-cylindrical or substantially co-cylindrical.

The axial protrusion portion 134 may be a cylindrical protrusion extending generally axially away from the socket portion 132. The axial protrusion 134 may include multi diameters, and in particular may include a first diameter 135 and a second diameter 136, the first diameter 135 being smaller than the second diameter 136. Specifically, the first diameter 135 may be configured to have an outer diameter that is smaller or equal to the inner diameter of the through bore 45 of the contact 40. The second diameter 136 may be configured to have an outer diameter that is equal to or slightly larger than the inner diameter of the through bore 45. The second diameter 136 may be configured on the protrusion 134 between the first diameter 135 and the socket 132. In this way, under the condition that the pin 130 is axially advanced toward the contact 40, the first diameter 135 enters the through bore 45 of the contact 40 prior to the second diameter 136 entering the through bore 45. In this way, the first diameter 135 may function to guide the pin 130 into the through bore 45 and may establish physical, electrical, and operational contact with the contact 40, and the second diameter 136 may function to ensure that the through bore 45 establishes physical, electrical, and operational contact with the contact 40 via the through bore 45. The first diameter 135 may include a tapered leading edge to facilitate efficient initial entry into the through bore 45. The axial protrusion 134 may also include one or more axially oriented slits (not shown) in either, or both, of the first diameter 135 and the second diameter 136. The slits permit the respective diameters 135 and 136 of the axial protrusion 134 to radially contract under the condition that the axial protrusion 134 is inserted into and engaged by the through bore 45.

The geometry of and resultant functional engagement of the through bore 45 with the first and second diameters 135 and 136 of the axial protrusion 134 may ensure that the pin 130 fully engages the contact 40 and may provide delayed timing for fixed engagement of the socket 132 to the strand 18 as the center conductive strand 18 enters the socket 132. This delayed timing is a result of the first diameter 135 not fixedly engaging the through bore 45 to allow the second diameter 136 to enter and more securely engage the through bore 45, which allows the conductive strand 18 to further enter the socket 132 prior to being fixedly engaged by the engagement fingers 137 of the socket 132, due to the compressive force exerted by the opening 59 on the engagement fingers 137 as they axially transition deeper into the socket 132. The pin 130, including the protrusion 134 and the socket 132 of the pin 130 should be formed of conductive materials such as, but not limited to, plated brass.

In addition, the geometry of and resultant functional engagement of the through bore 45 with the first and second diameters 135 and 136 may alternatively ensure that the pin 130 may continue to axially transition through the through bore 45 even after the center conductive strand 18 enters the socket 132 and is fixedly engaged by the socket 132. In this way, despite the socket 132 fixedly engaging the center conductive strand 18 to prohibit further axial advancement of the center conductive strand 18 within the socket 132, the pin 130 may continue to axially advance, and thus so too does the center conductive strand 18 coupled thereto. In other words, should the socket 132 fixedly couple the center conductive strand 18 therein to prohibit further axial advancement of the strand 18 prior to the connector 100 achieving the second state, the pin 130, with the strand 18 coupled thereto, may nevertheless continue to axially advance within the through bore 45 to allow the connector 100, and in particular the outer conductive layer 14, to reach the second state without damaging, deforming, or otherwise diminishing the performance of the outer conductive layer 14 or the connector 100. The outer conductive layer 14 and the center conductive strand 18 are thus permitted to axially advance at the same time and at the same rate until the connector 100 has achieved the second state.

Referring still to FIGS. 1 and 3, embodiments of connector 100 may include a first insulator body 50. The first insulator body 50 may include a first end 51, a second end 52, an internal surface 53, and an outer surface 54. The first insulator body 50 may be disposed within the diameter 38 of the main body 30. For example, the first insulator body 50 may be disposed or otherwise located in the generally axial opening of the second end 32 of the main body 30. The first insulator body 50 may further include an opening 59 extending axially through the first insulator body 50 from the first end 51 to the second end 52. The opening 59 may be a bore, hole, channel, tunnel, and the like, that may have a tapered surface 55 proximate the second end 52 of the first insulator body 50. The first insulator body 50, in particular, the opening 59 of the first insulator body 50 may accept, receive, accommodate, etc., an incoming center conductive strand 18 of the coaxial cable 10 as a coaxial cable 10 is further inserted into the main body 30. The diameter or general size of the opening 59 should be large enough to accept the center conductive strand 18 of the coaxial cable 10, and may be approximately the same diameter or general size of the socket 132 of the pin 130. For instance, the opening 59 of the first insulator body 50 may be tapered or substantially cylindrical, and may be sized and dimensioned to provide only a slight clearance for the pin 130, and specifically the socket 132, such that when the connector 100 is transitioned from the first state to the second state, the internal geometry of the connector 100 may avoid point contact between the opening 59 and the socket 132 that may otherwise result from a larger amount of clearance between the socket 132 and the opening 59. Indeed, the internal geometry of the first insulator body 50 and the socket 132 may avoid undesirable point contact, and instead establish line contact between the center conductive strand 18 and the socket 132. The internal surface 53 of the opening 59, tapered or otherwise, may initially engage the plurality of engagement fingers 137, and as the coaxial cable 10 is further inserted into the main body 30, the internal surface 53 of the opening 59 may compress the resilient engagement fingers 137 onto or around the center conductive strand 18 in a co-cylindrical or substantially co-cylindrical manner. Accordingly, the internal surface 53 acts to gradually and evenly compress and squeeze the socket 132 (i.e. engagement fingers 137) onto, or around, the center conductive strand 18 to achieve parallel line contact between the socket 132 and the center conductive strand 18 as the coaxial cable 10 is axially inserted into the main body 30. In embodiments of the connector 100, the tapered surface 55, positioned inside the opening of the first insulator body 50 proximate or otherwise near the second end 52, is adapted to resist further axial advancement of the socket 132 within the opening 59, as the exterior angled surface 138 of the socket 132 is configured to engage the corresponding tapered surface 55 under the condition that the connector 100 is transitioned from the first state to the second state.

Figure 4:
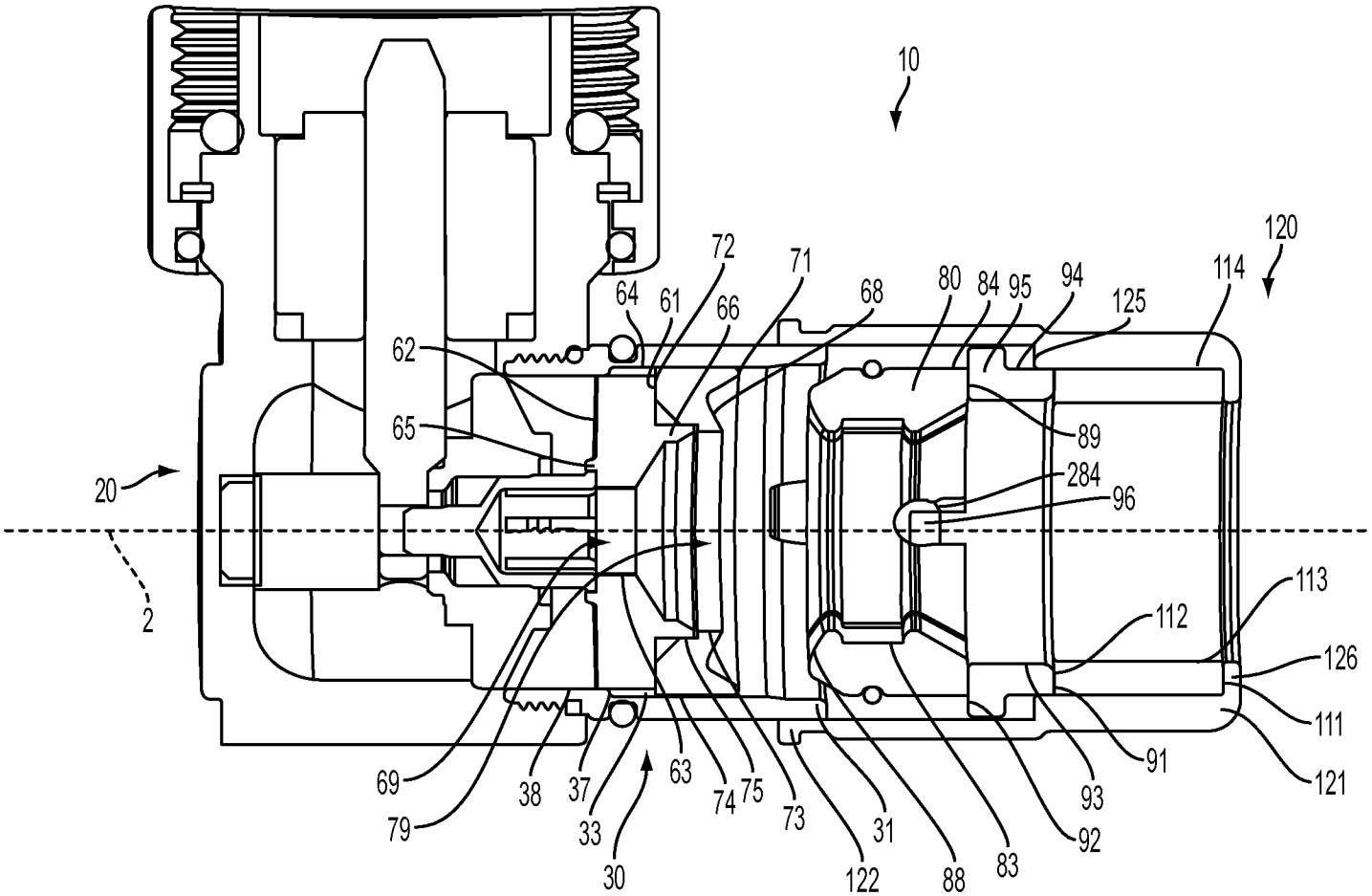
FIG. 4 depicts a cross-sectional view of an embodiment of a connector in an open position.

Referring still to FIGS. 1 and 3, embodiments of the connector 100 may include the first insulator body 50 having a diameter of the outer surface 54 that is substantially the same or slightly smaller than the diameter 38 of the generally axial opening of the second end 32 of the main body 30 to allow axial displacement of the first insulator body 50 within the main body 30. The first end 51 of the first insulator body 50 may face a second end 62 of a second insulator body 60. Further embodiments of the first insulator body 50 may include an annular indention 57 proximate or otherwise near the first end 51 of the first insulator body 50. The annular indention 57 may be sized and dimensioned to receive or otherwise engage an annular protrusion 65 extending from the face of the second end 62 of the second insulator body 60, as shown in FIG. 4. Furthermore, the first insulator body 50 should be made of non-conductive, insulator materials. Manufacture of the first insulator body 50 may include casting, extruding, cutting, turning, drilling, compression molding, injection molding, spraying, or other fabrication methods that may provide efficient production of the component.

Referring now to FIGS. 1 and 4, embodiments of the connector 100 may include a second insulator body 60. The second insulator body 60 may include a first end 61, a second end 62, an internal surface 63, an outer surface 64, and a substantially tubular body 66 extending from the face of the first end 61. The second insulator body 60 may be disposed within the diameter 38 of the main body 30. For example, the second insulator body 60 may be disposed or otherwise located in the generally axial opening between the first end 31 and the second end 32 of the main body 30. The second insulator body 60 may further include a through bore 69 extending axially through the second insulator body 60 from the first end 61 to the second end 62. The through bore 69 may be a bore, hole, channel, tunnel, and the like and may have a dimension slightly larger than the center conductive strand 18, such that the strand 18 can pass therethrough under the condition that the cable 10 is axially advanced within the connector 100. Moreover, the diameter or general size of the through bore 69 should be large enough to accept the center conductive strand 18 of the coaxial cable 10, and may be approximately the same diameter or general size of the initial opening diameter of the socket 132 of the pin 130. For instance, the through bore 69 may be sized and dimensioned to provide a clearance for the strand 18, such that when the connector 100 is transitioned from the first state to the second state, the internal geometry of the second insulator body 60, and in particular the through bore 69, when the connector 100 is transitioned from the first state to the second state or when the cable 10 is axially advanced within the connector 100, the conductive strand 18 passes through and is merely guided, or supported, by the through bore 69.

As mentioned above, embodiments of the connector 100 may include an annular protrusion 65 protruding off the face of the second end 62 and a tubular body 66 protruding of the face of the first end 61 of the second insulator body 60. The diameter of the annular protrusion 65 may be slightly larger than the diameter of the through bore 69. In this way, the engagement fingers 137 of the socket 132 can fit within the annular protrusion 65 and yet remain open enough to receive the conductive strand 18 therein. The annular protrusion may sustain the orientation of the socket 132 with respect to the second insulator body 60 prior to compression of the connector 100 into its second state. As the connector 100 is transitioned from its first state to its second state, the annular protrusion 65 slides into, or is otherwise received into the annular indention 57 that is positioned on the face of the first end 51 of the first insulating body 50. The engagement of the annular protrusion 65 within the annular indention 57 in the compressed second state ensures proper and secure engagement between the first and second insulator bodies 50 and 60. Specifically, an outside face of the annular protrusion 65 may be tapered to gradually engage the annular indention 57 as the first insulator body 50 receives or otherwise engages the second insulator body 60 to more fully secure the bodies 50 and 60 together. With reference to FIG. 4, the tubular body 66 may protrude off the face of the first end 61 of the second insulator body and be configured to engage an annular notch 75 in a second end 72 of a compression ring 70.

Referring still to FIGS. 1 and 4, embodiments of the connector 100 may include the second insulator body 50 having a diameter defined by the outer surface 64 that is substantially the same or slightly smaller than the diameter 38 of the generally axial opening of the second end 32 of the main body 30 to allow axial displacement of the second insulator body 60 within the main body 30. The first end 51 of the first insulator body 50 may face a second end 62 of a second insulator body 60, such that, in the compressed state, the first end 51 of the insulator body 50 engages the second end 62 of the second insulator body 60.

Referring still to FIGS. 1 and 4, embodiments of the connector 100 may include a compression ring 70. The compression ring 70 may include a first end 71, a second end 72, an internal surface 73, and an outer surface 74. The compression ring 70 may be disposed within the diameter 33 of the main body 30. For example, the compression ring 70 may be disposed or otherwise located in the generally axial opening of the first end 31 of the main body 30. The compression ring 70 may further include an opening 79 extending axially through the compression ring 70 from the first end 71 to the second end 72. The opening 79 may be a bore, hole, channel, tunnel, and the like, and in particular, the opening 79 of the compression ring 70 may accept, receive, accommodate, etc., an incoming center conductive strand 18 of the coaxial cable 10 as a coaxial cable 10 is further inserted into the main body 30. The diameter or general size of the opening 79 should be large enough to accept at least the center conductive strand 18 of the coaxial cable 10, and perhaps should be large enough to accept the dielectric 16, if necessary. The opening 79 may be generally about the same diameter or general size of the diameter of the tubular body 66, however the opening 79 may be slightly smaller than the diameter of the tubular body 66 such that the tubular body 66 does not axially advance within the opening 79, but instead abuts or otherwise engages the annular notch 75 on the face of the second side 72 of the compression ring 70.

Embodiments of the connector 100 may include the compression ring 70 having a diameter defined by the outer surface 74 that is substantially the same or slightly smaller than the diameter 33 of the generally axial opening of the first end 32 of the main body 30 to allow axial displacement of the compression ring 70 within the main body 30. Under the condition that the connector 100 is axially advanced from the first state to the second state, the compression ring 70 axially advances toward the second insulator body 60 and engages the second insulator body to axially advance the second insulator body toward the first insulator body 50, which concurrently axially advances the pin 130 into the opening 59 of the first insulator body 50, which thus pushes the protrusion 134 of the pin 130 into and somewhat through the through bore 45 of the contact 40. Specifically with regard to the engagement of the compression ring 70 and the second insulator body 60, the annular notch 75 in the compression ring 70 engages the tubular body 66 while the second end 72 of the compression ring 70 engages the first end 61 of the second insulator body 60. The outer surface 74 of the compression ring 70 slides along the diameter 33 of the main body 30 while the outer surface 64 of the second insulator member 60 slides along the diameter 38 of the main body 30. The compression ring 70 axially advances within the main body 30 until the second end 72 of the compression ring 70 abuts or otherwise engages the inner shoulder 37 on the inner surface 34 of the main body 30. Under the condition that the connector 100 is transitioned from the first state to the second state, the second end 72 of the compression ring 70 may engage the inner shoulder 37, the second end 62 of the second insulator body 60 may engage the first end 51 of the first insulator body 50, as described in greater detail above, and the exterior angled surface 138 of the socket 132 may engage the tapered surface 55 of the first insulator body 50.

Embodiments of the connector 100 may include the compression ring 70 having a first end 71 that may face a mating edge 88 of an outer conductor engagement member 80 and a portion of the outer conductor 14 as the coaxial cable 10 is advanced through the main body 30. The first end 71 may be configured to be a concave compression surface 78 and the mating edge 88 may be configured to be a convex compression surface. These corresponding compression surfaces 78 and 88 may be configured to clamp, grip, collect, or mechanically compress a conductive strand layer 14 therebetween.

Referring again to FIGS. 1 and 4, embodiments of connector 100 may include an outer conductor engagement member 80. The outer conductor engagement member 80 may include a first end 81, a second end 82, an inner surface 83, and an outer surface 84. The outer conductor engagement member 80 may be disposed within the compression member 120 proximate or otherwise near the flanged bushing 90. For instance, the outer conductor engagement member 80 may be disposed between the flanged bushing 90 and second end 122 of the compression member 120. Under the condition that the compression member 120 initially slidably engages the first end 31 of the main body 30, the outer conductor engagement member 80 be disposed between the flanged bushing 90 and the compression ring 70. Moreover, the outer conductor engagement member 80 may be disposed around the outer conductive strand 14 of the cable 10, wherein the inner surface 33 may engage, threadably or otherwise, the outer conductive strand 14. For example, the inner surface 83 may include threads or grooves that may correspond to the threads or grooves of the outer conductive strand 14. Embodiments of the outer conductor engagement member 80 may include an inner surface 83 with threads or grooves that correspond with a helical corrugated outer conductor. Embodiments of the outer conductor engagement member 80 may include an inner surface 83 with a recessed channel or groove that corresponds with and functions to engage and retain a raised portion of a corrugated outer conductor. Other embodiments of the outer conductor engagement member 80 may include an inner surface 83 with threads or grooves that correspond with a spiral corrugated outer conductor. Further embodiments of the outer conductor engagement member 80 may include an inner surface 83 that suitably engages a smooth wall outer conductor. Furthermore, embodiments of the outer conductor engagement member 80 may include a first mating edge 88 proximate or otherwise near the second end 82 and a second mating edge 89 proximate or otherwise near the first end 71. The first mating edge 88 may engage the concave compression surface 78 of the compression ring 70 as the coaxial cable 10 is further inserted into the axial opening of the main body 30. Similarly, the second mating edge 89 may engage a first mating edge 98 of the flange bushing 90 as the coaxial cable is advanced through the main body 30. Furthermore, the outer conductor engagement member 80 may be made of conductive materials. Manufacture of the outer conductor engagement member 80 may include casting, extruding, cutting, turning, drilling, compression molding, injection molding, spraying, or other fabrication methods that may provide efficient production of the component.

Embodiments of connector 100 may further include an outer conductor engagement member 80 having the outer conductor engagement member 80 being comprised of three separate parts 280 that are identical in structure. The parts 280 can be placed together to form the annular-shaped outer conductor engagement member 80 shown in FIG. 6. The parts 280 define therebetween slits 282. Because the parts 280 are separate pieces divided by the slits 282, the parts 280 of the outer conductor engagement member 80 move with respect to one another under force. Specifically, the slits 282 allow the parts 280 to radially displace with respect to one another in response to the forces acting thereupon. For example, during assembly of the connector 100, the cable 10 may be inserted into the connector 100 and through the outer conductor engagement member 80. In response, the individual parts 280 radially displace with respect to one another to allow the raised corrugated portions of the outer conductive layer 14 to pass therethrough. Likewise, the individual parts 280 may radially contract or relax with respect to one another as the recessed corrugated portions of the outer conductive layer 14 pass therethrough. Moreover, in embodiments of the connector 100, under the condition that the compression member 120 is axially advanced over the main body 30, the outer conductor engagement member 80 is axially advanced within the main body 30 and the inner surface 34 of the main body 30 radially compresses the respective parts 280 of the outer conductor engagement member 80 onto the outer conductive layer 14 to establish sufficient electrical contact therebetween.

Figure 6:
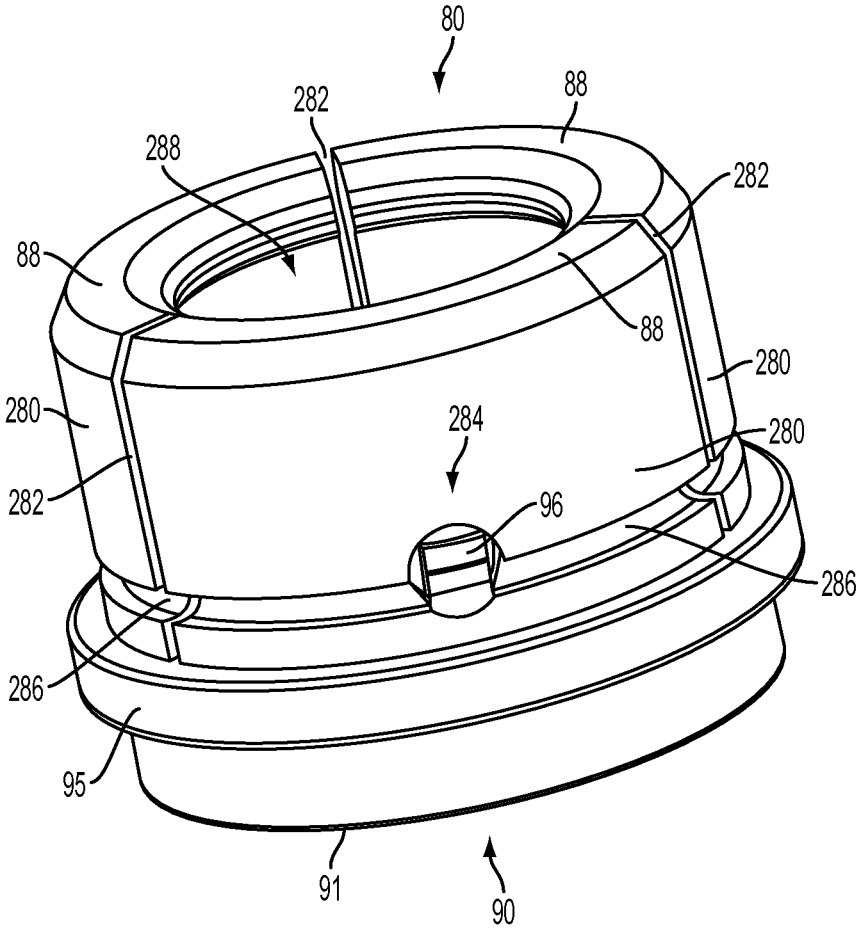
FIG. 6 depicts selected components of the connector depicted in the Figures.

Embodiments of connector 100 may further include the individual parts 280 further comprising axial holes 284 in the face of the first end 81. The axis of each of the holes 284 is substantially axially aligned parallel with the axis 2 of the connector 100 and is structurally configured, or at least has a diameter large enough, to receive one of the hooks 96 of the flanged bushing 90. The hole 284 in each part 280 may be configured in a central portion of the face of the first end 81 and extend axially to a distance within the individual part 280. In embodiments of the connector 100, the hole 284 extends a distance to communicate with the groove 286. In the first state, the hooks 96 slide into or are otherwise received by the holes 284 in the outer conductor engagement member 80. Embodiments of the connector 100 may further include the outer conductor engagement member 80 having a groove 286 in the outer periphery of the outer conductor engagement member 80, the groove 286 being capable of housing an O-ring that holds the parts 280 loosely together with respect to one another to form the outer conductor engagement member 80. Also, the groove 286 may be cut to a depth to expose a side portion of the axial holes 284, which is depicted in FIG. 6, such that the groove 286 and the holes 284 are in communication, as mentioned above. The hook 96 can be visible through a side portion of the hole 284. In this manner, each individual part 280 of the outer conductor engagement member 80 can be placed over a respective hook 96 of the flanged bushing 90. Thereafter, the O-ring mentioned above can be inserted into the groove 286 such that the hook portion of the hooks 96 hooks over, or otherwise engages, the O-ring, thus securing the flanged bushing 90 to each part 280 of the outer conductor engagement member 80, and vice versa. In other words, the functional interaction of the O-ring and the hooks 96 aid in retaining the individual parts 280 of the outer conductor engagement member 80 together with the flanged bushing 90.

Embodiments of connector 100 may further include the inner surface 83 of each part 280 of the outer conductor engagement member 80 defining an interior channel 288 and raised edge portions on either side of the channel 288. The size and shape of the channel 288 may be structurally configured so as to correspond to the size and shape of the corrugated surface of the conductive layer 14 of the cable 10. For example, the channel 288 can be configured to make physical and/or electrical contact with the raised corrugations and recessed corrugations of the outer conductive layer 14. Specifically, the channel 288 may be structured to engage one of the raised corrugations, whereas the raised edge portions of the channel 288, or the exterior portions of the channel 288, are structured to engage the recessed corrugations on either side of the particular raised corrugation engaged by the channel 288.

Embodiments of connector 100 may further include a flanged bushing 90. The flanged bushing 90 may include a first end 91, a second end 92, an inner surface 93, and an outer surface 94. The flanged bushing 90 may be a generally annular tubular member. The flanged bushing 90 may be disposed within the compression member 120 proximate or otherwise near the outer conductor engagement member 80. For instance, the flanged bushing 90 may be disposed between the bushing 110 and the outer conductor engagement member 80. Moreover, the flanged bushing 90 may be disposed around the dielectric 16 of the coaxial cable 10 when the cable 10 enters the connector 100. Further embodiments of the flanged bushing 90 can include a flange 95 proximate or otherwise near the second end 92. The flange 95 may protrude or extend a distance from the outer surface 94. The flange 95 may slidably engage the inner surface 123 of the compression member 120 and as the flanged bushing 90 axially advances within the compression member 120. As the connector 100 is transitioned from the first state, open position, to the second state, closed position, the flange 95 may be engaged by the shoulder 125 on the inner surface 123 of the compression member 120, such that the shoulder 125 contacts the flange 95 and axially advances the flange 95 until the flange 95 contacts, or comes into proximity with, the face of the first end 31 of the main body 30. The first end 91 of the flanged bushing 90 may contact, or otherwise engage, the second end 112 of the bushing 110, whereas the second end 92 of the flanged bushing 90 may contact, or otherwise engage, the first end 81 of the outer conductor engagement member 80. In embodiments of the connector 100, the flanged bushing 90 may further comprises the hook 96 protruding off the face of the second end 92. The flanged bushing 90 may include multiple hooks 96 spaced equidistant around the circumference of the face of the second end 92. The number of hooks 96 should correspond with the number of holes 284 in the outer conductor engagement member 80. Hooks 96 have a base that axially protrudes from the face of second end 92 near the interior diameter of the flanged bushing 90 defined by the center bore. From the base, the hooks 96 hook, or otherwise bend, radially outward. However, the hooks 96 do not extend beyond the outer periphery of the flanged bushing 90. Additionally, the flanged bushing 90 may be made of non-conductive, insulator materials. Manufacture of the flanged bushing 90 may include casting, extruding, cutting, turning, drilling, compression molding, injection molding, spraying, or other fabrication methods that may provide efficient production of the component.

With reference still to FIGS. 1 and 4, embodiments of connector 100 may include a bushing 110. The bushing 110 may include a first end 111, a second end 112, an inner surface 113, and an outer surface 114. The bushing 110 may be a generally annular tubular member. The bushing 110 may be a solid sleeve bushing and may be disposed within the connector body 120 proximate or otherwise near the flanged bushing 90. For instance, bushing 110 may be disposed between the flanged bushing 90 and the annular lip 126 and disposed around the dielectric 16 of the coaxial cable 10 when the cable 10 enters the connector body 120. The first end 111 of the bushing 110 may be configured to be engaged by the annular lip 126 and the second end 112 of the bushing 110 may be configured to engage the first end 91 of the flanged bushing 90 under the condition that the compression member 120 and the main body 30 are axially advanced toward one another to transition the connector 100 from the first state to the second state. In the second state, the bushing 110 is axially displaced between the lip 126 and the first end 91 of the flanged bushing 90, causing the bushing 110 to radially displace inwardly to compress against the jacket 12 of the cable 10. Such interaction hermetically seals the connector 100 at the interface between the busing 90 and the jacket 12 to prevent the ingress of external contaminants into the connector 100. Additionally, the bushing 110 should be made of non-conductive, insulator materials. Manufacture of the bushing 110 may include casting, extruding, cutting, turning, drilling, compression molding, injection molding, spraying, or other fabrication methods that may provide efficient production of the component.

Embodiments of connector 100 may also include a compression member 120. The compression member 120 may have a first end 121, second end 122, inner surface 123, and outer surface 124. The compression member 120 may be a generally annular member having a generally axial opening therethrough. The compression member 120 may be configured to engage a portion of the main body 30. For example, the second end 122 of the compression member 120 may be configured to surround, envelop, or otherwise engage the first end 31 of the main body 30. The second end 122 of the compression member 120 may engage the O-ring 36 in the annular groove 35, such that the second end 122 passes over the O-ring 36 and the inner surface 123 of the compression member 120 compresses the O-ring 36 into the groove 35 as the connector 100 moves from an open to a closed position. For instance, the compression member 120 may axially slide towards the second end 32 of the main body 30 until the second end 12, and in particular the inner surface 123, physically or mechanically engages the O-ring 36 in the groove 35 on the outer surface 34 of the main body 30. Engagement between the inner surface 123 and the O-ring 36 hermetically seals the connector 100 and prevents the ingress of contaminants into the connector 100.

In embodiments of the connector 100, the compression member 120 may include an annular lip 126 proximate or otherwise near the first end 121. The annular lip 126 may be configured to engage the bushing 110 and axially advance the bushing 110 as the connector 100 is moved to a closed position. The annular lip 126 may extend into the axial opening of the connector body 120, and may be sized, or otherwise configured, to permit the cable 10, including the outer jacket 12, to pass therethrough. Moreover, the compression member 120 may further include a shoulder 125 on the inner surface 123 of the compression member 120, the shoulder 125 facing the second end 122 of the compression member 120. Under the condition that the compression member 120 and the main body 30 are axially advanced toward one another to transition the connector 100 from the first state to the second state, the shoulder 125 engages the flange 95 to axially advance the flanged bushing 90 within the compression member 120 until the flange 95 contacts or otherwise arrives in close proximity to the first end 31 of the main body.

Furthermore, it should be recognized, by those skilled in the requisite art, that the compression member 120 may be formed of rigid materials such as metals, hard plastics, polymers, composites and the like, and/or combinations thereof. Furthermore, the compression member 120 may be manufactured via casting, extruding, cutting, turning, drilling, knurling, injection molding, spraying, blow molding, component overmolding, combinations thereof, or other fabrication methods that may provide efficient production of the component.

In addition to the structural and functional interaction described above with regard to component parts of the connector 100, referring now to FIGS. 1 and 3-5, the manner in which connector 100 may move from a first state, an open position, to a second state, a closed position, is further described. FIGS. 3 and 4 depict an embodiment of the connector 100 in an open position. The open position may refer to a position or arrangement wherein the center conductive strand 18 of the coaxial cable 10 is not clamped or captured by the socket 132 of the pin 130, or is only partially/initially clamped or captured by the socket 132. The open position may also refer to a position or arrangement wherein the protrusion 134 of the pin 130 is not inserted or captured by the through bore 45 of the contact 40, or is only partially/initially clamped or captured by the through bore 45. The open position may also refer to a position or arrangement wherein the outer conductive layer 14 is not clamped or captured between the compression surfaces 78 and 88, or is only partially/initially clamped or captured between the compression surfaces 78 and 88. The cable 10 may enter the generally axially opening of the compression member 120, and the outer conductive strand 14 engages the outer conductor engagement member 80. The outer conductive strand 14 may mate with the outer conductor engagement member 80. For example, the outer conductive strand 14 may be threaded onto the outer conductor engagement member 80. In some embodiments, the connector 100 may be rotated or twisted to provide the necessary rotational movement of the outer conductor engagement member 80 to mechanically engage, or threadably engage, the outer conductive strand 14. Alternatively, in other embodiments, the coaxial cable 10 may be rotated or twisted to provide the necessary rotational movement of the outer conductor engagement member 80 to mechanically engage, or threadably engage, the outer conductive strand 14. Alternatively, in other embodiments, the parts 280 of the outer conductor engagement member 80 may radially displace to allow the corrugations of the outer conductive layer 14 to pass thereunder until a prepared length of the cable 10 has been inserted sufficiently into the connector 100 prior to transitioning the connector 100 from the first state to the second state. In embodiments of the invention, the prepared length may be a distance of the outer conductive layer 14 that exposes three successive raised corrugations. In addition, the center conductive strand 18 may extend further beyond the prepared end of the outer conductive layer 14. The engagement between the outer conductive strand 14 and the outer conductor engagement member 80 may establish a mechanical connection between the connector 100 and the coaxial cable 10. Those skilled in the art should appreciate that mechanical communication or interference may be established without threadably engaging an outer conductive strand 14, such as friction fit between the cable 10 and the connector 100.

Figure 5:
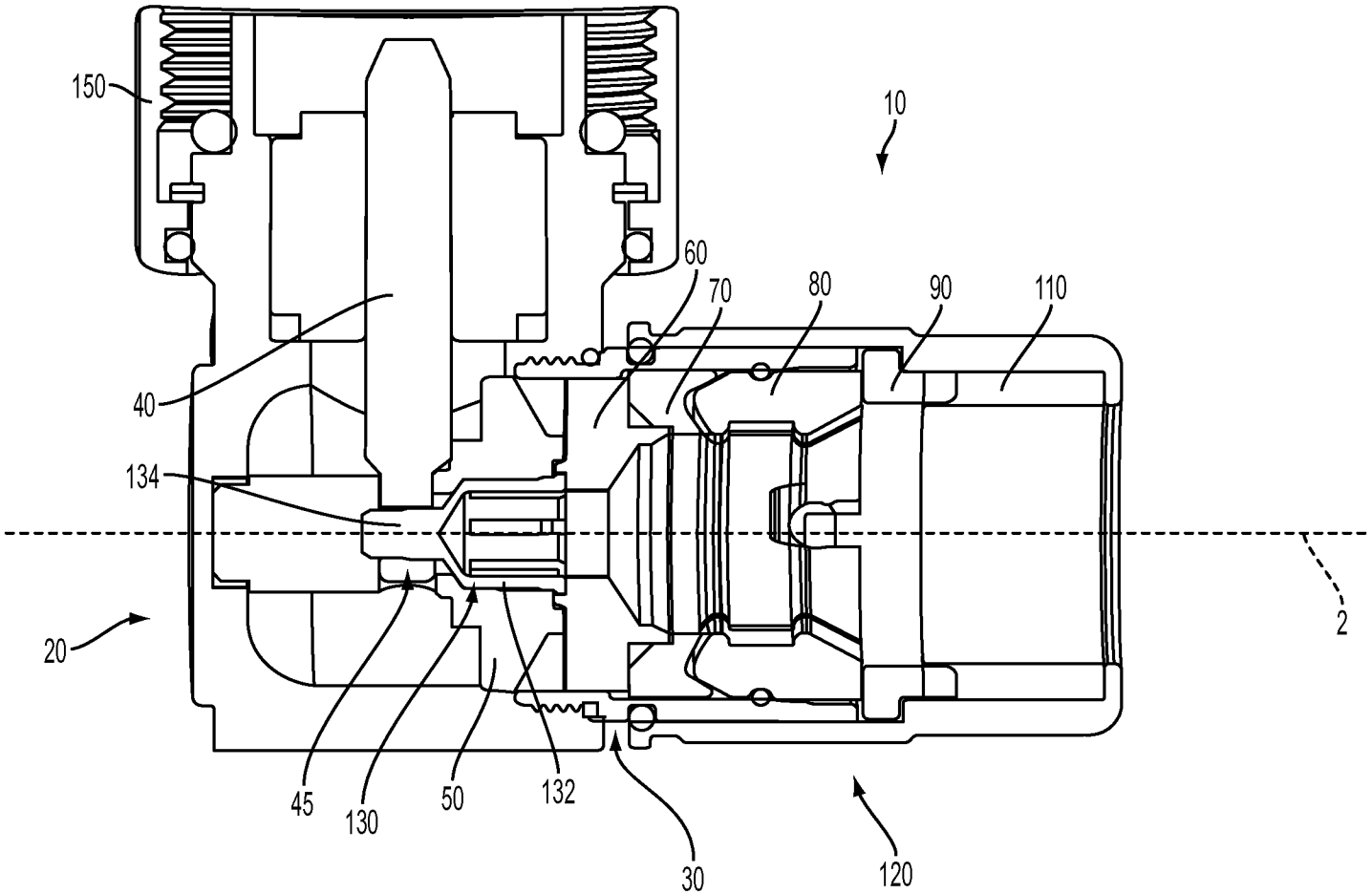
FIG. 5 depicts a cross-sectional view of an embodiment of a connector in a closed position.

FIG. 5 depicts an embodiment of a closed position of the connector 100, or the connector 100 in the second state. The closed position may refer to a position or arrangement wherein the center conductive strand 18 of the coaxial cable 10 is fully clamped or captured by the socket 132 of the pin 130. The closed position may also refer to a position or arrangement wherein the protrusion 134 of the pin 130 is fully inserted or captured by the through bore 45 of the contact 40. The closed position may also refer to a position or arrangement wherein a leading end of the prepared portion of the outer conductive layer 14 is fully clamped or captured between the compression surfaces 78 and 88. The closed position may also refer to a position or arrangement incorporating one or more of the above.

The closed position may be achieved by axially compressing the compression member 120 onto the main body 30. The axial movement of the compression member 120 can axially displace the cable 10 and other components disposed within the compression member 120, such as the bushing 110, the flanged bushing 90, and the outer conductor engagement member 80, because of the mechanical engagement between the lip 126 of the compression member 120 and the bushing 110. When the lip 126 engages the bushing 110, the bushing 110 may then mechanically engage the flanged bushing 90, which may mechanically engage the outer conductor engagement member 80. The outer conductor engagement member 80 may engage the compression ring 70, which may engage the second insulator body 60, which may engage the socket 132 to axially displace the socket 132 into the opening 59 of the first insulator body 50, which may axially displace the protrusion 134 of the pin 130 into and partially through the through bore 45 of the contact 40. In addition, the axial advancement of the outer conductor engagement member 80 concurrently functions to axially displace the cable 10 within the connector 100 due to mechanical interference between the outer conductor engagement member 80 and the outer conductive strand 14, as described above.

In view of the foregoing description, the placement and configuration of the component parts of the connector 100 may operate to concurrently move, engage, and operationally configure the outer conductive layer 14 between compression surfaces 78 and 88 as well as the inner conductive strand 18 with the contact 40. In other words, as the connector 100 is transitioned between the open position and the closed position, both the outer conductive layer 14 and the inner conductive strand 18 may be concurrently axially transitioned at substantially the same rate so as to not stretch or otherwise deform either the inner conductive strand 18 or the outer conductive layer 14 during assembly of the connector 100 from the first state to the second state. As a result, the inner conductive strand 18 may be adequately electrically coupled to the socket 132 and therefore the contact 40, which is oriented orthogonally to the axial displacement of the socket 132, while the outer conductive layer 14 may be adequately electrically coupled between the outer conductor engagement member 80 and the compression ring 70, thus ensuring proper impedance matching and acceptable levels of PIM performance.

Relating the above to the connector 100, if, for example, the protrusion 134 of the pin 130 could not slide into the through bore 45 of the contact 40, then once the engagement fingers 137 of the socket 132 fixedly engage the center conductive strand 18 at a point within the socket 132, the center conductive strand 18 could not continue to axially advance within the connector 100. For example, in conventional right-angled connectors, once the center conductor is fixedly coupled within the connector, the center conductor can no longer axially advance within the connector to reach the second state without stretching, disfiguring, or otherwise deforming the outer conductor to do so. At times during assembly of the cable and the connector, the center conductor is fixedly coupled to the corresponding portion of the connector prematurely, or in other words, prior to the outer conductor being electrically coupled to its corresponding portion of the connector. Under this scenario, where the center conductor has reached an operational state and is fixedly coupled to the connector but the outer conductor must continue to axially advance to reach the operational state, the outer conductor must therefore necessarily stretch or otherwise deform to reach that operational state. Such deformation of the outer conductor leads to impedance mismatch, poor return loss, higher levels of PIM, and overall poor connector performance.

However, the above-described configuration of the connector 100 prevents such a scenario, due to the functional interaction between the component parts of the connector 100, and in particular the protrusion 134 of the pin 130 and the through bore 45 of the contact 40. For example, even after the engagement fingers 137 of the socket 132 fixedly engage the center conductive strand 18 within the socket 132 and preclude axial advancement of the center conductive strand 18 within the socket 132, the pin 130 may nevertheless continue to axially advance within the opening 59 of the first insulator body 50 and the pin 130 may continue to axially advance within the through bore 45 of the contact 40. In this way, even though the center conductive strand 18 is fixedly coupled within the socket 132 and achieves an operational state, the center conductive strand 18 is not prohibited from continued axial advancement to allow the outer conductive layer 14 to axially advance to reach the operational state. Thus, should continued axial advancement be needed by the outer conductive layer 14 to reach the operational state (i.e., the second state, a closed configuration) the center conductive strand 18, although fixedly coupled to the socket 132, can effectively axially advance via the structural configuration between the socket 132 and the opening 59 and the protrusion 134 and the through bore 45.

The structural configuration of the connector 100 may allow the center conductive strand 18 and the outer conductive layer 14 to axially advance concurrently and at substantially the same rate within the connector 100, even after the center conductive strand 18 is fixedly secured within the socket 132, until the center conductive strand 18 electrically couples to the contact 40 and the outer conductive layer 14 electrically couples between the compression surfaces 88 and 78, thus ensuring that the connector 100 has reached the operational state, i.e., the second state. Alternatively, the structural configuration of the connector 100 may allow the center conductive strand 18 and the outer conductive layer 14 to axially advance concurrently and at substantially the same rate within the connector 100 such that the center conductive strand 18 electrically couples to the socket 132 concurrently with the pin 130 that electrically couples to the contact 40 and concurrently with the outer conductive layer 14 that electrically couples between the compression surfaces 88 and 78, thus ensuring that the connector 100 has reached the operational state, the second state. Alternatively, the structural configuration of the connector 100 may allow the center conductive strand 18 and the outer conductive layer 14 to axially advance at substantially the same rate within the connector 100 such that the outer conductive layer 14 electrically couples between the compression surfaces 88 and 78 prior to the center conductive strand 18 being electrically coupled to the socket 132 or the pin 130 being electrically coupled to the contact 40, thus ensuring that the connector 100 has reached the operational state, the second state. It follows that embodiments of the connector 100 may provide that the inner conductive strand 18 and the outer conductive layer 14 axially advance within the connector 100 concurrently and at substantially the same rate until both the conductive strand 18 and the outer conductive layer 14 each make their respective operational coupling within the connector 100, as described above.

Thus, regardless of the particular timing and/or order of the inner conductive strand 18 being fixedly coupled to the socket 132 or the outer conductive layer 14 being fixedly coupled between compression surfaces 88 and 78 as the connector 10 is transitioned from the first state to the second state, as described above, the inner conductive strand 18 and the outer conductive layer 14 maintain their positioning with respect to one another as components of the cable 10. Consequently, neither is axially advanced without the respective axial advancement of the other. In this way, the inner conductive strand 18 and the outer conductive layer 14 of the cable 10 are not axially displaced with respect to one another, resulting in acceptable levels of performance of the cable 10 and the connector 100 being achieved.

Figure 7:
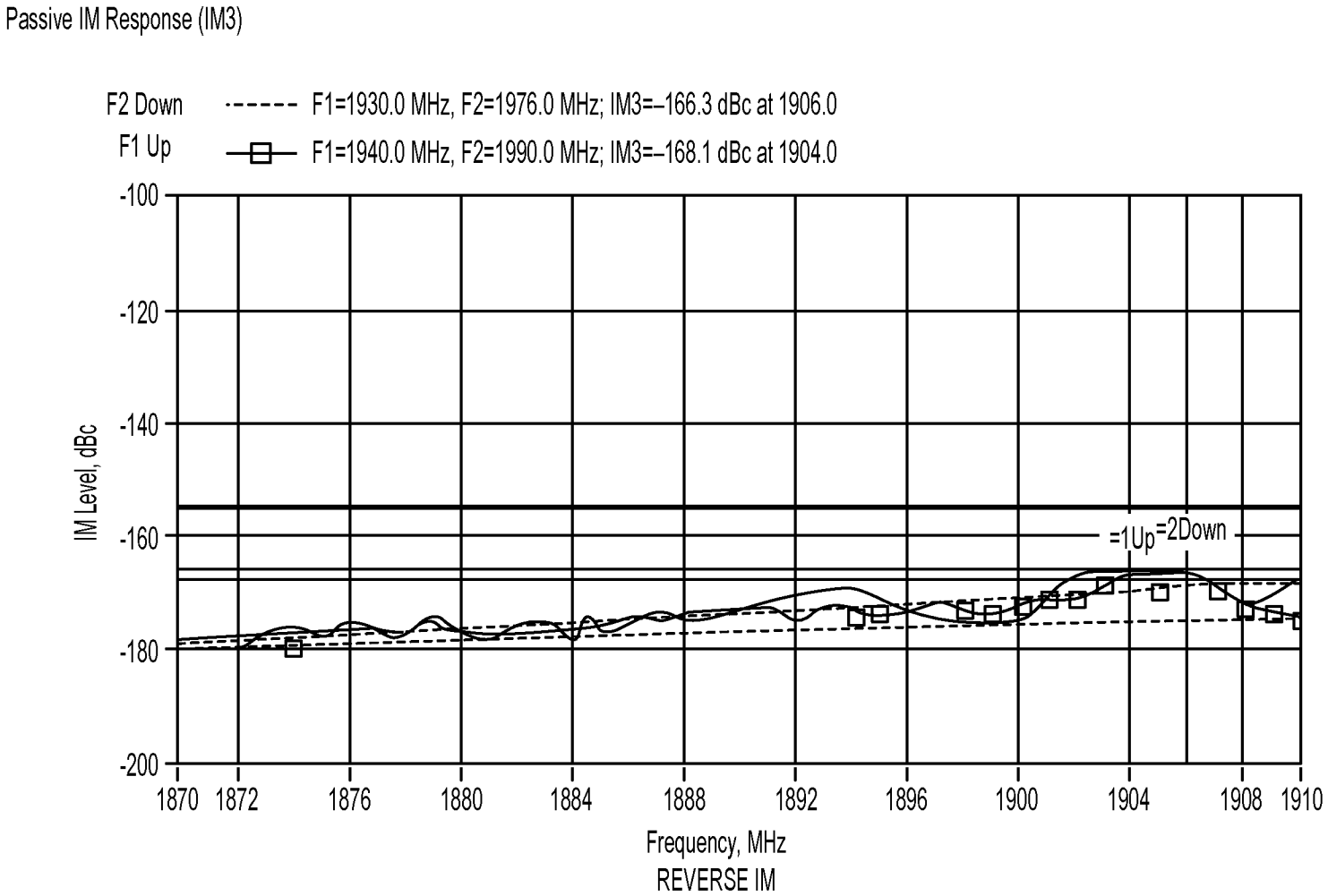
FIG. 7 depicts a view of a chart and associated graphical depiction showing a performance of an embodiment of the connector.

For example, FIG. 7 discloses a chart showing the results of PIM testing performed on the coaxial cable 10 that was terminated using the example compression connector 100. The particular test used is known to those having skill in the requisite art as the International Electrotechnical Commission (IEC) Rotational Test. The PIM testing that produced the results in the chart was also performed under dynamic conditions with impulses and vibrations applied to the example compression connector 100 during the testing. As disclosed in the chart, the PIM levels of the example compression connector 100 were measured on signals F1 UP and F2 DOWN to vary significantly less across frequencies 1870-1910 MHz. Further, the PIM levels of the example compression connector 100 remained well below the minimum acceptable industry standard of −155 dBc. For example, F1 UP achieved an intermodulation (IM) level of −168.1 dBc at 1904 Mhz, while F2 DOWN achieved an intermodulation (IM) level of −166.3 dBc at 1906 Mhz. These superior PIM levels of the example compression connector 100 are due at least in part to the concurrent axial advancement of the inner conductive strand 18 and the outer conductive layer 14 until both achieve an operational state when the connector 100 is transitioned from the first state to the second state, as described supra.

Compression connectors having PIM greater than this minimum acceptable standard of −155 dBc result in interfering RF signals that disrupt communication between sensitive receiver and transmitter equipment on the tower and lower-powered cellular devices in 4G systems. Advantageously, the relatively low PIM levels achieved using the example compression connector 100 surpass the minimum acceptable level of −155 dBc, thus reducing these interfering RF signals. Accordingly, the example field-installable compression connector 100 enables coaxial cable technicians to perform terminations of coaxial cable in the field that have sufficiently low levels of PIM to enable reliable 4G wireless communication. Advantageously, the example field-installable compression connector 100 exhibits impedance matching and PIM characteristics that match or exceed the corresponding characteristics of less convenient factory-installed soldered or welded connectors on pre-fabricated jumper cables. Accordingly, embodiments of connector 100 may be a compression connector, wherein the compression connector achieves an intermodulation level less than −155 dBc over a frequency of 1870 MHz to 1910 MHz.

Figure 8:
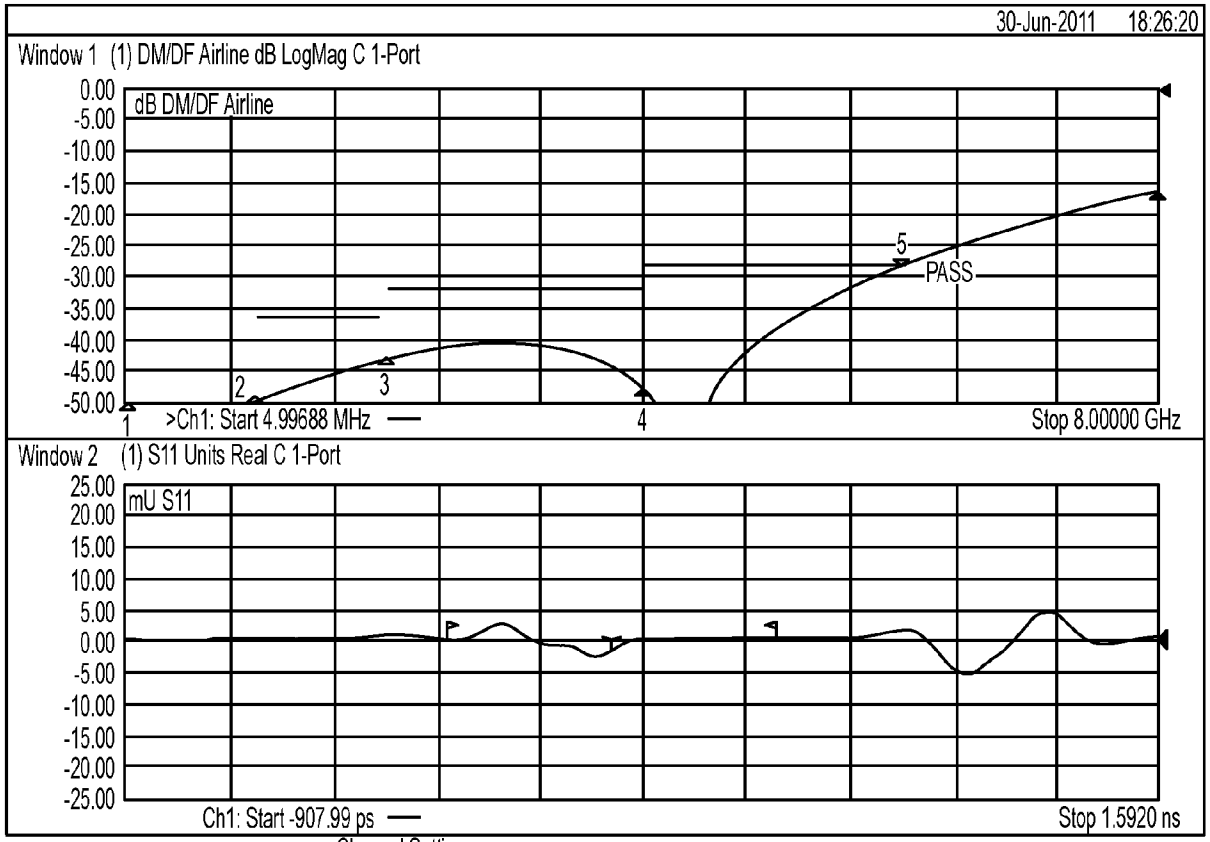
FIG. 8 depicts a view of graphical depictions showing additional performance of an embodiment of the connector.
Figure 9A:
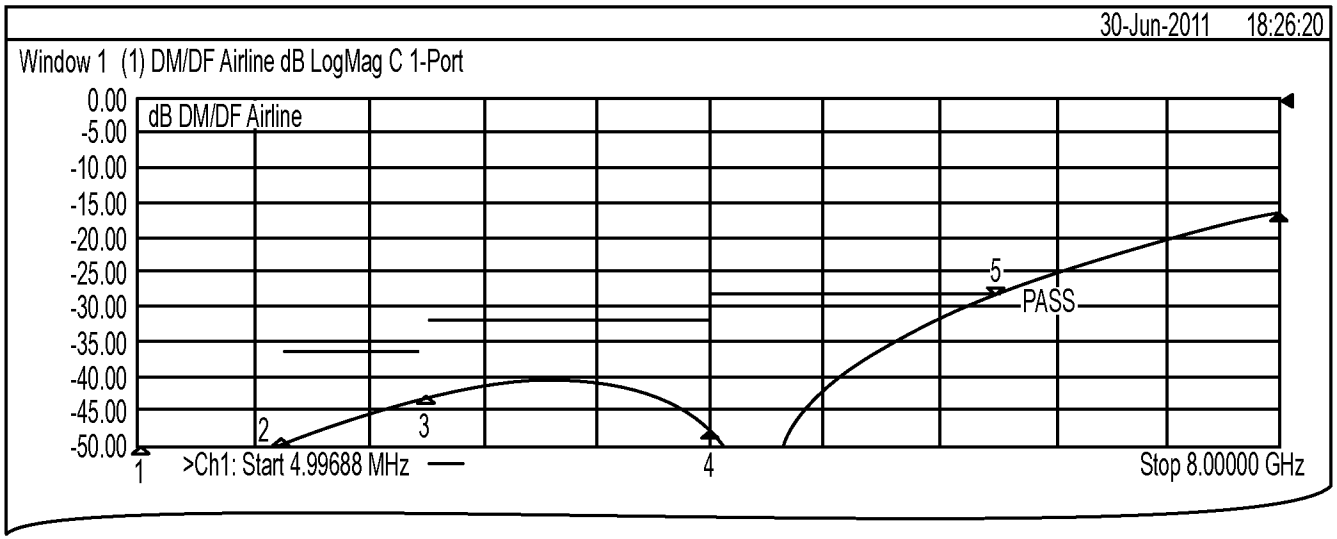
FIGS. 9A-9B depict a chart of the data corresponding to the view of FIG. 8.
Figure 9B:
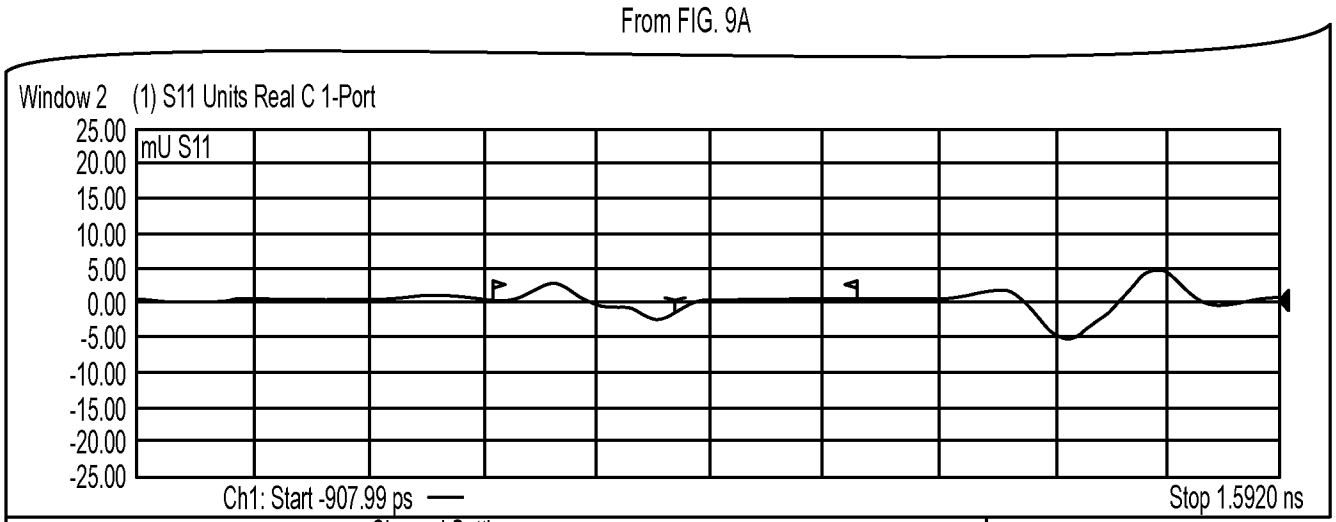

For example, FIGS. 8 and 9 disclose charts, corresponding graphical depictions, and associated data showing the results of "return loss" testing and impedence testing performed on the coaxial cable 10 that was terminated using the example compression connector 100. Return loss as shown in FIGS. 8 and 9 is expressed in −dB and reflects the ratio of the power of the reflected signal vs. the power of the incident signal. Thus, return loss, as measured, indicates how perfectly or imperfectly the coaxial cable line is terminated. The particular test was conducted according to the standards set by the International Electrotechnical Commission (IEC) and known to those having ordinary skill in the requisite art. The return loss testing that produced the results in the chart was also performed under dynamic conditions with impulses and vibrations applied to the example compression connector 100 during the testing. As disclosed in the graph of FIG. 8 and the accompanying data chart of FIG. 9, Window 1 displays a graph of the measured return loss over frequencies ranging from 5 MHz to 8,000 MHz. Window 1 also discloses a graduated limit 400 that graduates depending on a frequency range. The return loss at a specific frequency should not be less than the graduated limit 400 set for the frequency range. As disclosed in FIG. 9, the chart lists five markers (1-5) that denote the measured ratio of the return loss at a specific frequency. These markers are visible on the chart disclosed in Window 1 of FIG. 8. As depicted in FIGS. 8 and 9, at 5 MHz the return loss measured −58.402 dB and over the frequency range between 5 MHz and 1,000 MHZ the return loss measured less than −50 dB. At 1,000 MHz the return loss measured −49.56 dB and over the frequency range between 1,000 MHz and 2,000 MHz the return loss measured below −43.000 dB, well below the graduated limit of approximately −36.000 dB set for this range. At 2,000 MHz the return loss measured −43.122 dB and over the frequency range between 2,000 MHz and 4,000 MHz the return loss measured less than −40.000 dB, well below the graduated limit of approximately −32.000 dB set for this range. At 4,000 MHz the return loss measured −48.007 dB and over the frequency range between 4,000 MHz and 6,000 MHz the return loss measured between −48.007 and −28.124 dB, below the graduated limit of approximately −28.000 dB set for this range. These superior return loss measurements of the example compression connector 100 are due at least in part to the concurrent axial advancement of the inner conductive strand 18 and the outer conductive layer 14 until both achieve an operational state when the connector 100 is transitioned from the first state to the second state, as described supra.

Compression connectors having return loss greater than the graduated limits associated with specific frequency ranges indicated in FIG. 8 result in interfering RF signals that disrupt communication between sensitive receiver and transmitter equipment; for example the connectors on cell towers and lower-powered cellular devices in 4G and 5G systems. Advantageously, the return loss measurements achieved using the example compression connector 100 are well below the graduated limits associated with specific frequency ranges indicated in FIG. 8, thus reducing these interfering RF signals. Accordingly, the example field-installable compression connector 100 enables coaxial cable technicians to perform terminations of coaxial cable in the field that have advantageous ratios of return loss to enable reliable 4G and 5G wireless communication. Advantageously, the example field-installable compression connector 100 exhibits return loss characteristics that match or exceed the corresponding characteristics of less convenient factory-installed soldered or welded connectors on pre-fabricated jumper cables. Accordingly, embodiments of connector 100 may be a compression connector, wherein the compression connector achieves return loss ratios below acceptable levels of return loss set by the graduated limits associated with specific frequency ranges indicated in FIG. 8.

As further depicted in FIG. 8 and in view of the data depicted in FIG. 9, Window 2 graphically depicts an impedance plot showing deviation of impedance. The two flag-like designators mark the limits of the gate and are associated with the condition of the test signal as it particularly passed through the tested embodiment of the connector 100. It is notable that the deviation of the impedance within the gate section is minimal, as shown by the fairly flat deviation line running with only marginal variance above and below the zero-point (0.00). This minimal deviation depicted in Window 2 of FIG. 8 indicates that the performance of the connector 100 is not significantly impaired or burdened by substantial impedance problems, even while the signal travels through the connector along a right-angle path. Hence, the data and graphical depictions of the charts shown in FIG. 8 and FIG. 9 work to validate the functional performance of the connector 100, in having minimal impedance deviation, acceptable return loss levels, and minimized signal impact associated with passive intermodulation.

Referring now to FIGS. 1-9, a method of ensuring desirable contact between the center conductive strand 18 of a coaxial cable 10 and an electrical contact 40 may comprise the steps of a providing a connector 100 including a main body 30, having a first end 31 and a second end 32, the main body 30 configured to receive a prepared coaxial cable 10, a contact 40 having a through bore 45, a pin 130 having a protrusion 134 and a socket 132, the through bore 45 configured to receive the protrusion 134, the socket 132 disposed within the main body 30 and configured to receive a center conductive strand 18 of the coaxial cable 10, a first insulator body 50 disposed within the main body 30, the first insulator body 50 having a first end 51 and a second end, an outer conductor engagement member 80 having a first end 81 and a second end 82, a compression member 120 having a first end 121 and a second end 122, and advancing the compression member 120 to axially advance the outer conductor engagement member 80 to axially advance the center conductive strand 18 into the socket 132, to concurrently axially advance the protrusion 134 of the pin 130 into the through bore 45, and to concurrently axially advance the outer conductive layer 14 of the coaxial cable 10 to achieve an operational state of the connector 100. Further, axial advancement of the center conductive strand 18 and the outer conductive layer 14 occurs concurrently and at the same rate until the center conductive strand 18 and the outer conductive layer 14 reach an operational state within the connector 100.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

The following is claimed:

1. A connector comprising:

a body configured to receive a cable, the body extending along orthogonal axes;

an insulator body secured within the body and having an opening defining an axis coincident with a first orthogonal axis;

a first conductive contact moveably positioned within the body and extending along the first orthogonal axis, the first contact having a pin and a socket disposed along the first orthogonal axis, the socket defining a plurality of fingers;

a second conductive contact moveably positioned within the body and extending along a second orthogonal axis, the second contact defining an aperture extending along the first orthogonal axis; and a component, engaging at least the inner conductor of the cable, and moveably coupled to the body along the first orthogonal axis, displacement of the component causing (i) the pin of the first contact to engage aperture of the second contact, (ii) the inner conductor to engage the socket of the first contact, and, (iii) the opening of the insulator body configured to cause socket to engage the inner connector of the cable, the first and second conductive contacts are operative to redirect signal transmission from the first axis to the second axis.

2. The connector of claim 1, the component comprising a compression member configured to engage an outer conductor of the cable.

3. The connector of claim 1, wherein the fingers are configured to radially compress the inner conductor of the cable.

4. The connector of claim 1 wherein the socket includes a plurality of fingers each having an external taper configured to move inwardly upon contact with an inner wall of the aperture so as to compress the inner conductor.

5. The connector of claim 1 wherein the fingers are radially compressed by the inner wall of the aperture.

6. A connector comprising:

a body configured to receive a cable;

a conductive pin moveably positioned within the body, the pin having a first end and a second end each extending along a first axis;

a conductive contact moveably positioned within the body along a second axis orthogonal to the first axis, the contact having an aperture; and a component slidably coupled to the body, the component configured to engage the first end of the pin and axially move the second end of the second end of the pin along the first axis into contact with the aperture of the contact, the conductive pin and contact operative to redirect signal transmission from the first axis to the second axis.

7. The connector of claim 6, wherein the first end of the pin comprises an inner conductor engager, the inner conductor engager comprising a plurality of fingers configured to engage an inner conductor of the cable, and wherein the second end of the pin is configured to engage the aperture of the contact.

8. The connector of claim 6, the component comprising a compression member configured to engage an outer conductor of the cable.

9. The connector of claim 6, further comprising an insulator body secured within the body and having an opening defining an axis coincident with a first orthogonal axis.

10. The connector of claim 6 wherein the socket includes a plurality of fingers each having an external taper configured to move inwardly upon contact with an inner wall of the aperture so as to compress the inner conductor.

11. The connector of claim 6 wherein the fingers are radially compressed by the inner wall of the aperture.

12. The connector of claim 6 wherein the inner wall is tapered radially inwardly to compress the fingers of the socket.

13. A connector comprising:

a housing configured to receive a cable, the housing comprising a plurality of housing components extending along different axes, the housing components including a front body and a main body;

an inner conductor engager moveably positioned within the main body of the housing along a first axis, the inner conductor engager comprising a conductive pin at a first end and a socket at a second end, the socket defining an opening configured to engage part of an inner conductor of the cable;

a conductive contact moveably positioned within the front body of the housing along a second axis orthogonal to the first axis, the contact defining an aperture having an axis coincident with the first axis; and a component moveably coupled within the housing, the component configured to move along the first axis, the movement at least indirectly causing the pin to engage the aperture of the contact;

the inner conductor engager and conductive contact redirecting signal transmission from the first axis to the second axis.

14. The connector of claim 13, further comprising an insulator body having an aperture extending along the first axis, the aperture causing the socket to positively engage the inner conductor.

15. The connector of claim 14 wherein the socket includes a plurality of fingers each having an external taper configured to move inwardly upon contact with an inner wall of the aperture so as to compress the inner conductor.

16. The connector of claim 14 wherein the fingers are radially compressed by the inner wall of the aperture.

17. The connector of claim 14 wherein the inner wall is tapered radially inwardly to compress the fingers of the socket.

18. The connector of claim 14 further comprising a compression member configured to engage the outer conductor of the cable to effect an electrical ground between the cable and the housing.

* * * * *